US010100988B2

(12) United States Patent
Rodgers et al.

(10) Patent No.: US 10,100,988 B2
(45) Date of Patent: Oct. 16, 2018

(54) LINEAR SHELF LIGHT FIXTURE WITH REFLECTORS

(71) Applicant: CREE, INC., Durham, NC (US)

(72) Inventors: Elizabeth Rodgers, Raleigh, NC (US); Benjamin Beck, Union Grove, WI (US); James Bowden, Fuquay-Varina, NC (US); Yaote Huang, Morrisville, NC (US); William Laird Dungan, Cary, NC (US)

(73) Assignee: CREE, INC., Durham, NC (US)

( * ) Notice: Subject to any disclaimer, the term of this patent is extended or adjusted under 35 U.S.C. 154(b) by 0 days.

(21) Appl. No.: 14/252,685

(22) Filed: Apr. 14, 2014

(65) Prior Publication Data

US 2015/0167902 A1 Jun. 18, 2015

Related U.S. Application Data

(63) Continuation-in-part of application No. 14/108,168, filed on Dec. 16, 2013.

(51) Int. Cl.
*F21K 99/00* (2016.01)
*F21V 23/00* (2015.01)
(Continued)

(52) U.S. Cl.
CPC ..... *F21S 8/03* (2013.01); *F21V 7/0016* (2013.01); *F21V 15/015* (2013.01);
(Continued)

(58) Field of Classification Search
CPC ..... F21V 7/0016; F21V 7/005; F21V 15/015; F21V 21/005
See application file for complete search history.

(56) References Cited

U.S. PATENT DOCUMENTS 3,589,660 A 6/1971 Dunckel
4,118,763 A 10/1978 Osteen ..... 359/833
(Continued)

FOREIGN PATENT DOCUMENTS

CN 1710323 A 12/2005
CN 2872082 2/2007
(Continued)

OTHER PUBLICATIONS

U.S. Appl. No. 13/649,052, filed Oct. 10, 2012, Lowes, et al.
(Continued)

*Primary Examiner* — Anh Mai
*Assistant Examiner* — Zachary J Snyder
(74) *Attorney, Agent, or Firm* — Koppel, Patrick, Heybl & Philpott

(57) ABSTRACT

A linear light fixture with gap filler elements. The fixture comprises two primary structural components: a base and a light engine, which may be removably attached. The base comprises a body with end panels at both ends and is mountable to an external structure. The light engine comprises the light sources, an elongated lens, and any other optical elements that tailor the outgoing light to a particular profile. External reflectors are included to further shape the output beam. The reflectors may be shaped to define louvers which direct some of the emitted light in a direction opposite the primary emission direction, e.g., as uplight. The fixtures may be connected in a serial arrangement using a joiner.

20 Claims, 19 Drawing Sheets

(51) Int. Cl.

| | |
|---|---|
| ***F21S 8/00*** | (2006.01) |
| ***F21V 21/005*** | (2006.01) |
| ***F21V 15/015*** | (2006.01) |
| ***F21V 7/00*** | (2006.01) |
| ***F21V 19/00*** | (2006.01) |
| *F21Y 103/10* | (2016.01) |
| *F21Y 115/10* | (2016.01) |

(52) U.S. Cl.
CPC ..... *F21V 19/0045* (2013.01); *F21V 19/0055* (2013.01); *F21V 21/005* (2013.01); *F21V 23/009* (2013.01); *F21Y 2103/10* (2016.08); *F21Y 2115/10* (2016.08)

(56) References Cited

U.S. PATENT DOCUMENTS 4,300,185 A 11/1981 Wakamatsu ..... 362/147
4,464,707 A 8/1984 Forrest ..... 362/271.06
4,472,767 A 9/1984 Wenman ..... 362/147
4,946,547 A 8/1990 Palmour et al.
5,200,022 A 4/1993 Kong et al.
5,335,890 A 8/1994 Pryor
RE34,861 E 2/1995 Davis et al.
5,530,628 A 6/1996 Ngai ..... 362/127
5,653,412 A 8/1997 Martorano
5,690,415 A 11/1997 Krehl ..... 362/125
5,823,663 A 10/1998 Bell et al.
5,907,218 A 5/1999 Altman et al.
5,951,150 A 9/1999 Helstern ..... 362/293
6,190,198 B1 2/2001 Ray
6,210,025 B1 4/2001 Schmidt et al.
6,350,041 B1 2/2002 Tarsa et al.
6,435,697 B1 8/2002 Simmons ..... 362/219
6,536,924 B2 3/2003 Segretto ..... 362/247
6,667,451 B1 12/2003 Hart ..... 200/314
6,739,734 B1 5/2004 Hulgan ..... 362/243
6,914,194 B2 7/2005 Fan
7,131,747 B1 11/2006 Yates ..... 362/219
7,213,940 B1 5/2007 Lu et al.
7,217,023 B2 5/2007 Iwasa et al. ..... 362/555
7,228,253 B2 6/2007 Chen ..... 318/11
7,267,461 B2 9/2007 Kan
7,303,310 B2 12/2007 You
7,387,410 B2 6/2008 Sibout ..... 362/375
7,520,636 B2 4/2009 Van Der Poel
7,540,627 B2 6/2009 Handsaker ..... 362/225
7,559,672 B1 7/2009 Parkyn et al.
7,591,578 B2 9/2009 Chang
7,628,506 B2 12/2009 Verfuerth et al. ..... 362/218
7,654,703 B2 2/2010 Kan et al. ..... 362/362
7,674,005 B2 3/2010 Chung ..... 362/147
7,722,220 B2 5/2010 Van de Ven et al.
7,758,207 B1 7/2010 Zhou ..... 362/217.1
7,791,061 B2 9/2010 Edmond et al.
8,058,088 B2 11/2011 Cannon et al.
8,206,004 B2 6/2012 Serak et al. ..... 362/217
8,220,953 B1 7/2012 Moore ..... 362/217.01
8,313,212 B1 11/2012 Mayer et al. ..... 362/219
8,317,369 B2 11/2012 McCanless ..... 362/368
8,342,714 B1 1/2013 Rea ..... 362/264
8,360,599 B2 1/2013 Ivey
8,376,578 B2 2/2013 Kong, II ..... 362/241
8,388,180 B2 3/2013 Chang et al.
8,459,824 B1 6/2013 Esmailzadeh et al. ..... 362/147
8,476,836 B2 6/2013 Van de Ven et al.
8,523,383 B1 9/2013 Grigore et al. ..... 362/221
8,678,611 B2 3/2014 Chu ..... 313/110
8,714,770 B2 5/2014 Kato ..... 362/217.06
8,764,220 B2 7/2014 Chan et al. ..... 362/217.02
8,777,448 B2 7/2014 Shimizu ..... 362/235
8,888,314 B2 11/2014 Gill
9,057,493 B2 6/2015 Silmon
2001/0048599 A1* 12/2001 Hess ..... F21S 8/04 362/290
2004/0240214 A1 12/2004 Whitlow et al. ..... 362/373
2004/0252521 A1 12/2004 Clark ..... 362/554
2005/0041418 A1 2/2005 Fan ..... 362/217.05
2005/0146867 A1 7/2005 Kassay ..... 362/217.05
2006/0050505 A1* 3/2006 McCarthy ..... F21S 2/00 362/219
2006/0266955 A1* 11/2006 Arvin ..... B05D 3/067 250/492.1
2006/0278882 A1 12/2006 Leung ..... 257/98
2007/0109330 A1 5/2007 Brown Elliott et al.
2007/0158668 A1 7/2007 Tarsa et al.
2007/0171647 A1 7/2007 Artwohl et al.
2007/0183148 A1 8/2007 Mayfield, III
2008/0128723 A1 6/2008 Pang
2008/0173884 A1 7/2008 Chitnis et al.
2008/0179611 A1 7/2008 Chitnis et al.
2008/0258130 A1 10/2008 Bergmann et al.
2008/0285267 A1 11/2008 Santoro ..... 362/224
2008/0314944 A1 12/2008 Tsai ..... 224/331
2009/0009999 A1 1/2009 Wang
2009/0040782 A1 2/2009 Liu et al. ..... 362/555
2009/0046457 A1 2/2009 Everhart ..... 362/235
2009/0161356 A1 6/2009 Negley et al. ..... 362/231
2009/0184333 A1 7/2009 Wang et al.
2009/0185379 A1 7/2009 Chen
2009/0207602 A1 8/2009 Reed et al. ..... 362/225
2009/0212304 A1 8/2009 Wang et al.
2009/0224265 A1 9/2009 Wang et al.
2009/0290345 A1 11/2009 Shaner ..... 362/249.01
2009/0290348 A1 11/2009 Van Laanen et al. ..... 362/249
2009/0296381 A1 12/2009 Dubord ..... 362/218
2010/0002426 A1 1/2010 Wu ..... 362/223
2010/0014289 A1 1/2010 Thomas ..... 362/235
2010/0110701 A1 5/2010 Liu ..... 362/373
2010/0128485 A1 5/2010 Teng ..... 362/294
2010/0142205 A1 6/2010 Bishop ..... 362/249.02
2010/0155763 A1 6/2010 Donofrio et al.
2010/0171404 A1 7/2010 Liu et al. ..... 313/46
2010/0214770 A1 8/2010 Anderson ..... 362/133
2010/0220469 A1 9/2010 Ivey et al. ..... 362/218
2010/0259927 A1 10/2010 Chien ..... 362/235
2010/0271804 A1 10/2010 Levine
2010/0271825 A1 10/2010 Black
2010/0328945 A1 12/2010 Song et al. ..... 362/240
2011/0006688 A1 1/2011 Shim ..... 315/119
2011/0007514 A1* 1/2011 Sloan ..... F21K 9/00 362/368
2011/0013400 A1 1/2011 Kanno et al.
2011/0028006 A1 2/2011 Shah et al. ..... 439/39
2011/0090682 A1 4/2011 Zheng ..... 362/218
2011/0103043 A1 5/2011 Ago ..... 362/147
2011/0163683 A1 7/2011 Steele et al. ..... 315/192
2011/0211330 A1 9/2011 Wang ..... 362/20
2011/0222270 A1 9/2011 Porciatti
2011/0285314 A1 11/2011 Carney et al. ..... 315/294
2011/0286207 A1 11/2011 Chan
2011/0286208 A1 11/2011 Chrn ..... 362/217.1
2011/0310604 A1 12/2011 Shimizu ..... 362/235
2011/0310614 A1* 12/2011 Budike, Jr. ..... F21S 4/20 362/294
2012/0002408 A1 1/2012 Lichten et al. ..... 362/218
2012/0020109 A1* 1/2012 Kim ..... F21S 2/005 362/606
2012/0051041 A1 3/2012 Edmond ..... 362/231
2012/0075857 A1 3/2012 Verbrugh ..... 362/249
2012/0081883 A1 4/2012 Wang ..... 362/101
2012/0092876 A1 4/2012 Chang et al.
2012/0098424 A1 4/2012 Arik ..... 315/35
2012/0120666 A1 5/2012 Moeller ..... 362/308
2012/0169234 A1 7/2012 Shew ..... 315/88
2012/0182755 A1 7/2012 Wildner ..... 362/555
2012/0201023 A1 8/2012 Yoneda
2012/0218757 A1 8/2012 Gill
2012/0235199 A1 9/2012 Andrews et al.
2012/0250302 A1 10/2012 Edwards
2013/0021803 A1 1/2013 Pickard
2013/0039090 A1* 2/2013 Dau ..... F21S 8/04 362/551
2013/0050998 A1 2/2013 Chu et al. ..... 362/218

(56) References Cited

U.S. PATENT DOCUMENTS

| | | | | |
|---|---|---|---|---|
| 2013/0093359 | A1 | 4/2013 | Hsu et al. | |
| 2013/0094224 | A1 | 4/2013 | Miyatake | |
| 2013/0094225 | A1 | 4/2013 | Leichner | 362/368 |
| 2013/0155670 | A1 | 6/2013 | Handsaker | 362/223 |
| 2013/0242548 | A1 | 9/2013 | Ter-Hovhannisyan | |
| 2013/0258616 | A1 | 10/2013 | Chao | |
| 2013/0271979 | A1 | 10/2013 | Pearson et al. | 362/235 |
| 2013/0279156 | A1 | 10/2013 | Kaule | 362/133 |
| 2013/0279180 | A1 | 10/2013 | Pearson et al. | 362/371 |
| 2013/0329425 | A1 | 12/2013 | Lowes et al. | |
| 2014/0043802 | A1 | 2/2014 | Dings | |
| 2014/0085861 | A1 | 3/2014 | Nicolai | 362/84 |
| 2014/0104843 | A1 | 4/2014 | McCane | |
| 2014/0265809 | A1 | 9/2014 | Hussell | |
| 2014/0313731 | A1 | 10/2014 | Kwak | |
| 2015/0016100 | A1 | 1/2015 | Ishii | 362/223 |
| 2015/0022999 | A1 | 1/2015 | Yu et al. | |
| 2015/0155427 | A1 | 6/2015 | Jang | |
| 2016/0025278 | A1 | 1/2016 | Camarota | |

FOREIGN PATENT DOCUMENTS

| | | | |
|---|---|---|---|
| CN | 101994939 | 3/2011 | |
| CN | 101994939 A | 3/2011 | |
| CN | 1019844284 | 3/2011 | |
| DE | WO 2008003289 | 1/2008 | F21S 4/003 |
| KR | 20100012997 | 12/2010 | |

OTHER PUBLICATIONS

U.S. Appl. No. 13/649,067, filed Oct. 10, 2012, Lowes, et al.
U.S. Appl. No. 13/770,389, filed Feb. 19, 2013, Lowes, et al.
U.S. Appl. No. 13/782,820, filed Mar. 1, 2013, Dixon, et al.
U.S. Appl. No. 12/873,303, filed Aug. 31, 2010, Edmond, et al.
U.S. Appl. No. 13/345,215, filed Jan. 6, 2012, Lu, et al.
U.S. Appl. No. 13/442,311, filed Apr. 9, 2012, Lu, et al.
U.S. Appl. No. 13/463,709, filed May 11, 2009, Donofrio, et al.
U.S. Appl. No. 11/656,759, filed Jan. 22, 2007, Chitnis, et al.
U.S. Appl. No. 11/899,790, filed Sep. 7, 2007, Chitnis, et al.
U.S. Appl. No. 13/830,698, filed Mar. 14, 2013, Durkee, et al.
U.S. Appl. No. 29/462,422, filed Aug. 2, 2013, Lay, et al.
CirkalokTM conductive adhesive. 6972 and 6968, by Lord Corporation. 2 pages.
WhiteOpticstm White97 Film, Relfector Film Technical Data Sheet, White Optics, LLc, New Castle. DE.
U.S. Appl. No. 11/473,089, filed Mar. 21, 2006, Tarsa, et al.
U.S. Appl. No. 13/018,291, filed Jan. 31, 2011, Tong, et al.
U.S. Appl. No. 13/671,089, filed Nov. 7, 2012, Hussell, et al.
U.S. Appl. No. 13/662,618, filed Oct. 29, 2012, Athalye, et al.
U.S. Appl. No. 13/462,388, filed Aug. 10, 2011, Athalye, et al.
U.S. Appl. No. 13/207,204, filed Aug. 10, 2011, Athalye, et al.
Cree XLamp XH-G. Information Data Sheet. from www.cree.com/xlamp, 11 pages.
Cree CS18 8' LED Linear Luminaire from Cree. www.cree.com/lighting . 2 pages.
Office Action from U.S. Appl. No. 13/834,605, dated Apr. 9, 2015.
Office Action from U.S. Appl. No. 13/840,812, dated May 12, 2015.
Office Action from U.S. Appl. No. 13/910,486, dated May 7, 2015.
Office Action from U.S. Appl. No. 13/763,270, dated May 19, 2015.
Office Action from U.S. Appl. No. 29/449,316, dated Jun. 5, 2014.
Office Action from U.S. Appl. No. 13/842,150, dated Jun. 18, 2014.
Leviton LED Magnetic Tube Retrofit Series datasheet. 1 page. from www.leviton.com.
Restriction Requirement from U.S. Appl. No. 13/839,130, dated Jul. 28, 2014.
Office Action from U.S. Appl. No. 13/839,130, dated Sep. 25, 2014.
Office Action from U.S. Appl. No. 13/672,592, dated Jan. 7, 2015.
Office Action from U.S. Appl. No. 13/899,314, dated Jan. 15, 2015.
Office Action from U.S. Appl. No. 13/842,150. dated Jan. 22, 2015.
Office Action from U.S. Appl. No. 13/829,558, dated Mar. 9, 2015.
Office Action from U.S. Appl. No. 13/958,462, dated Mar. 10, 2015.
Office Action from U.S. Appl. No. 13/829,558. dated Sep. 30, 2014.
Office Action from U.S. Appl. No. 29/450,283. dated Nov. 5, 2014.
Office Action from U.S. Appl. No. 29/449,316. dated Nov. 26, 2014.
Office Action from U.S. Appl. No. 13/840,812. dated Nov. 28, 2014.
Office Action from U.S. Appl. No. 13/763,270, dated Oct. 3, 2014.
Office Action from U.S. Appl. No. 14/252,685. dated Oct. 1, 2015.
Office Action from U.S. Appl. No. 13/958,461. dated Oct. 15, 2015.
Office Action from U.S. Appl. No. 13/910,486. dated Oct. 15, 2015.
Response to OA from U.S. Appl. No. 13/910,486, filed Dec. 15, 2015.
Office Action from U.S. Appl. No. 13/782,820. dated Oct. 30, 2015.
Office Action from U.S. Appl. No. 12/899,314, dated Nov. 13, 2015.
Response to OA from U.S. Appl. No. 12/899,314, filed Dec. 16, 2015.
Office Action from U.S. Appl. No. 13/672,592, dated Nov. 23, 2015.
Office Action from U.S. Appl. No. 14/020,750, dated Dec. 14, 2015.
Office Action from U.S. Appl. No. 14/108,168: dated Dec. 24, 2015.
Office Action from U.S. Appl. No. 13/842,150: dated Dec. 30, 2015.
Office Action from U.S. Appl. No. 13/763,270; dated Jan. 12, 2016.
Office Action from U.S. Appl. No. 13/899,314: dated Feb. 4, 2016.
Office Action from U.S. Appl. No. 14/070,098; dated Feb. 5, 2016.
Office Action from U.S. Appl. No. 13/829,558; dated Feb. 19, 2016.
Office Action from U.S. Appl. No. 13/899,314, dated Jul. 29, 2015.
Response to OA from U.S. Appl. No. 13/899,314, filed Sep. 15, 2015.
Office Action from U.S. Appl. No. 13/672,592, dated Aug. 6, 2015.
Response to OA from U.S. Appl. No. 13/672,592, filed Sep. 21, 2015.
Office Action from U.S. Appl. No. 13/842,150, dated Aug. 10, 2015.
Office Action from U.S. Appl. No. 13/829,558, dated Sep. 11, 2015.
Office Action from U.S. Appl. No. 14/020,750; dated Jul. 20, 2016.
Office Action from U.S. Appl. No. 13/829,558; dated Aug. 16, 2016.
Office Action from U.S. Appl. No. 14/070,098; dated Sep. 9, 2016.
Office Action for U.S. Appl. No. 13/958,461; dated Jun. 17, 2016.
Office Action for U.S. Appl. No. 13/910,486; dated Jun. 23, 2016.
Office Action for U.S. Appl. No. 13/763,270; dated Jul. 15, 2016.
Office Action from U.S. Appl. No. 13/910,486; dated Mar. 1, 2016.
Office Action from U.S. Appl. No. 14/108,168; dated May 20, 2016.
Office Action for U.S. Appl. No. 14/108,168: dated Nov. 15, 2016.
Office Action for U.S. Appl. No. 13*/910,486; dated Dec. 14, 2016.
Chinese Office Action Application No. 201310236572; dated Jan. 4, 2017.
Office Action for U.S. Appl. No. 14/020,750: dated Jan. 25, 2017.
Office Action for U.S. Appl. No. 14/070,098; dated Oct. 23, 2017.
Office Action for U.S. Appl. No. 14/108,168; dated Nov. 2, 2017.
Office Action for U.S. Appl. No. 13/829,558; dated Apr. 10, 2017.
Office Action for U.S. Appl. No. 13/910,486; dated Apr. 20, 2017.
Office Action for U.S. Appl. No. 13/763,270; dated Jun. 16, 2017.
Office Action for U.S. Appl. No. 14/108,168; dated Jun. 20, 2017.
Office Action for U.S. Appl. No. 14/070,098; dated Jul. 7, 2017.
Foreign Office Action for Chinese Application No. 2013101236572; dated Jul. 10, 2017.
Office Action for U.S. Appl. No. 13/910,486; dated Aug. 28, 2017.
Office Action for U.S. Appl. No. 13/829,558; dated Oct. 4, 2017.
Search Report for Chinese Application No. 2013101236572; dated Jan. 22, 2018.
Fourth Office Action for Chinese Application No. 2013101236572 dated Jan. 30, 2018.
Office Action for U.S. Appl. No. 13/910,486; dated Feb. 5, 2018.
Office Action for U.S. Appl. No. 13/763,270; dated Mar. 10, 2018.
Office Action for U.S. Appl. No. 14/108,168; dated Mar. 22, 2018.
Office Action for U.S. Appl. No. 13/829,558; dated May 2, 2018.
Office Action for U.S. Appl. No. 13/910,486; dated Jun. 29, 2018.
Office Action for U.S. Appl. No. 14/070,098; dated Jun. 28, 2018.

* cited by examiner

FIG. 5a
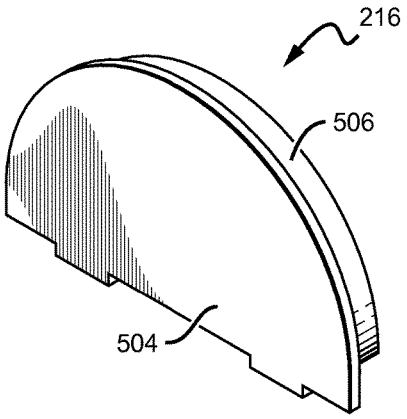
FIG. 5b
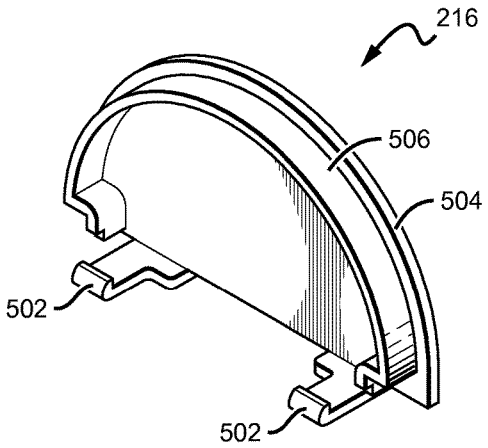
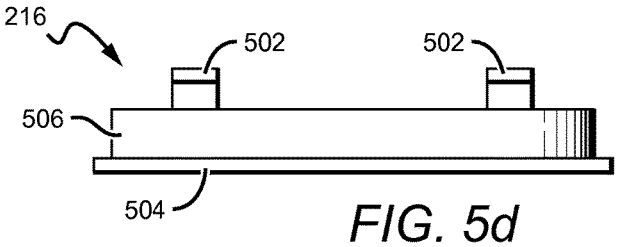
FIG. 5d
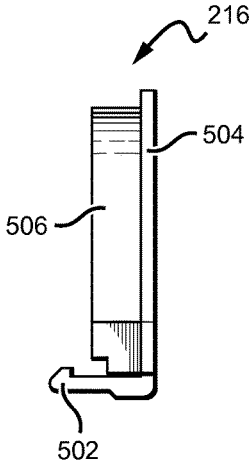
FIG. 5e
FIG. 5c
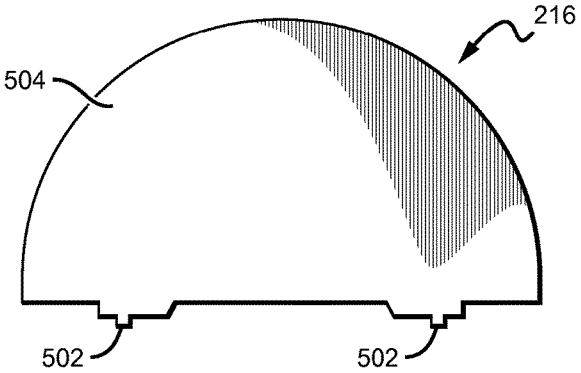
FIG. 5f
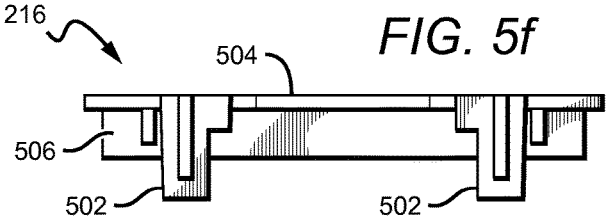

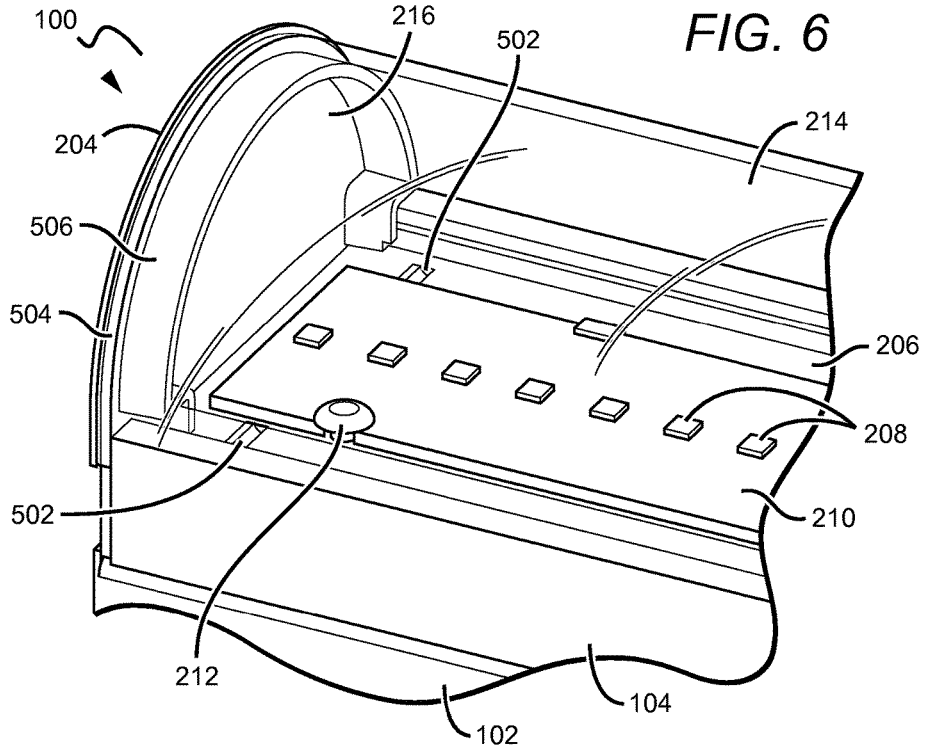
FIG. 6
FIG. 7a
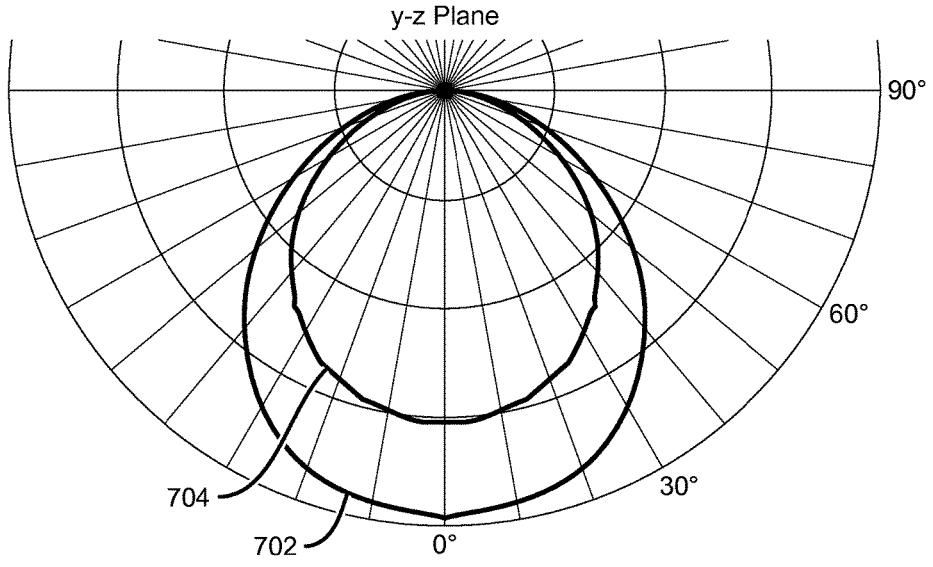

Fixture 100

Zonal Lumen Summary

| Zone | Lumens | %Lamp | %Fixt |
|---|---|---|---|
| 0-20 | 363.5 | N.A. | 9.20 |
| 0-30 | 783.19 | N.A. | 19.80 |
| 0-40 | 1303.35 | N.A. | 32.90 |
| 0-60 | 2400.99 | N.A. | 60.60 |
| 0-80 | 3235.78 | N.A. | 81.70 |
| 0-90 | 3499.89 | N.A. | 88.30 |
| 10-90 | 3406.83 | N.A. | 86.00 |
| 20-40 | 939.82 | N.A. | 23.70 |
| 20-50 | 1499.47 | N.A. | 37.90 |
| 40-70 | 1564.34 | N.A. | 39.50 |
| 60-80 | 834.79 | N.A. | 21.10 |
| 70-80 | 368.08 | N.A. | 9.30 |
| 80-90 | 264.11 | N.A. | 6.70 |
| 90-110 | 297.62 | N.A. | 7.50 |
| 90-120 | 372.39 | N.A. | 9.40 |
| 90-130 | 417.67 | N.A. | 10.50 |
| 90-150 | 455.44 | N.A. | 11.50 |
| 90-180 | 461.65 | N.A. | 11.70 |
| 110-180 | 164.03 | N.A. | 4.10 |
| 0-180 | 3961.54 | N.A. | 100.00 |

Standard 2-Lamp Flourescent Strip

Zonal Lumen Summary

| Zone | Lumens | %Lamp | %Fixt |
|---|---|---|---|
| 0-20 | 183.41 | 18341.00 | 4.10 |
| 0-30 | 497.57 | 49757.00 | 11.10 |
| 0-40 | 941.11 | 94111.00 | 20.90 |
| 0-60 | 2057.97 | 205797.00 | 45.70 |
| 0-80 | 3149.14 | 314914.00 | 70.00 |
| 0-90 | 3646.00 | 364600.00 | 81.00 |
| 10-90 | 3625.38 | 362538.00 | 80.60 |
| 20-40 | 757.70 | 75770.00 | 16.80 |
| 20-50 | 1293.85 | 129385.00 | 28.80 |
| 40-70 | 1693.83 | 169383.00 | 37.60 |
| 60-80 | 1091.17 | 109117.00 | 24.20 |
| 70-80 | 514.20 | 51420.00 | 11.40 |
| 80-90 | 496.86 | 49686.00 | 11.00 |
| 90-110 | 366.08 | 36608.00 | 8.10 |
| 90-120 | 569.62 | 56962.00 | 12.70 |
| 90-130 | 712.87 | 71287.00 | 15.80 |
| 90-150 | 840.80 | 84080.00 | 18.70 |
| 90-180 | 854.17 | 85417.00 | 19.00 |
| 110-180 | 488.10 | 48810.00 | 10.80 |
| 0-180 | 4500.17 | 450017.00 | 100.00 |

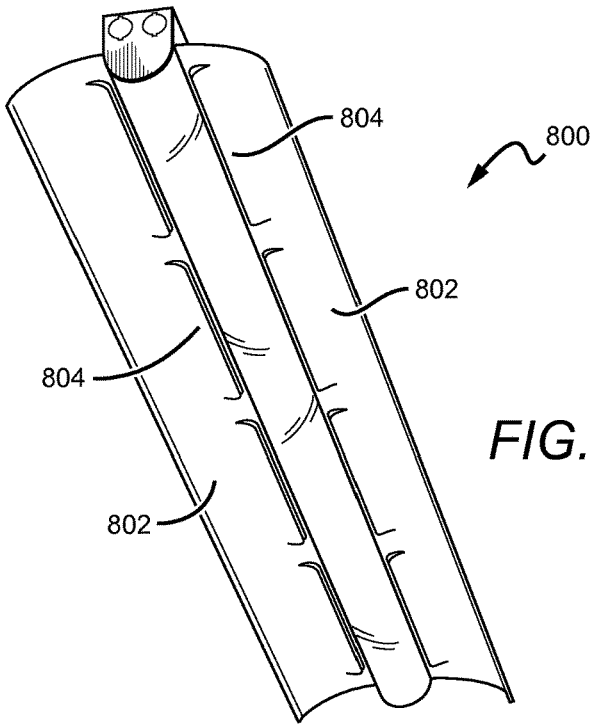
FIG. 8a
FIG. 8b
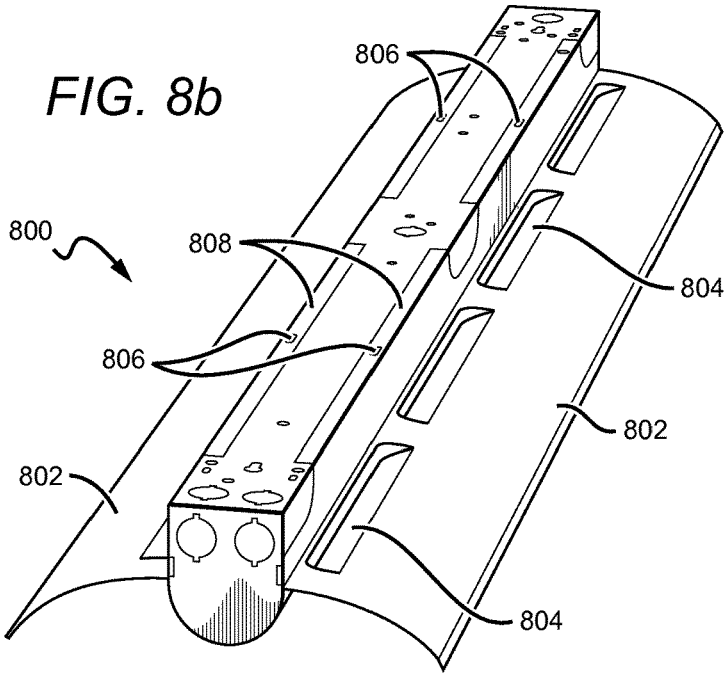

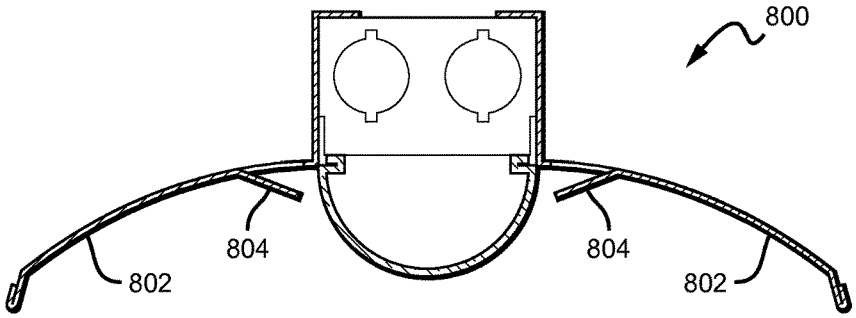
FIG. 8c
FIG. 9
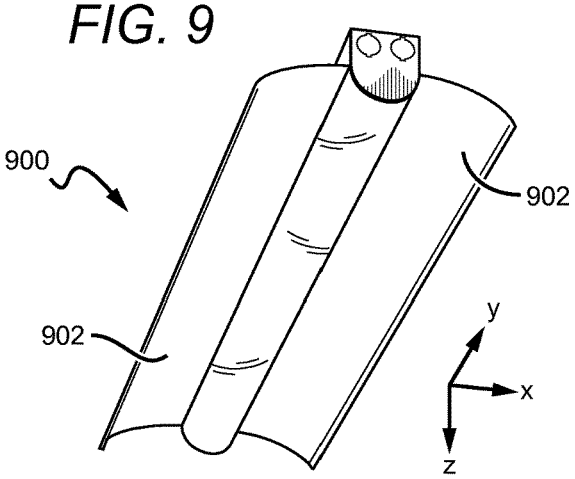
FIG. 10a
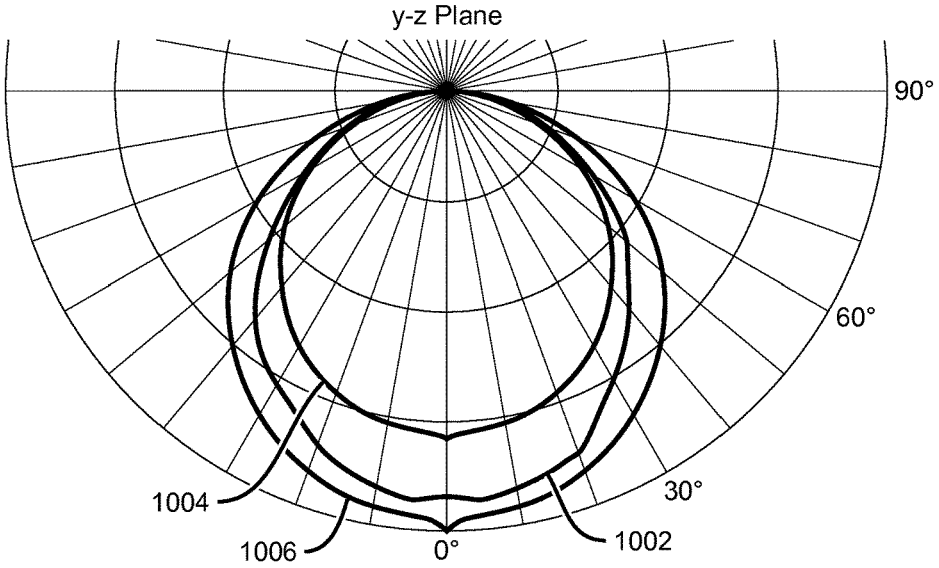

FIG. 10b
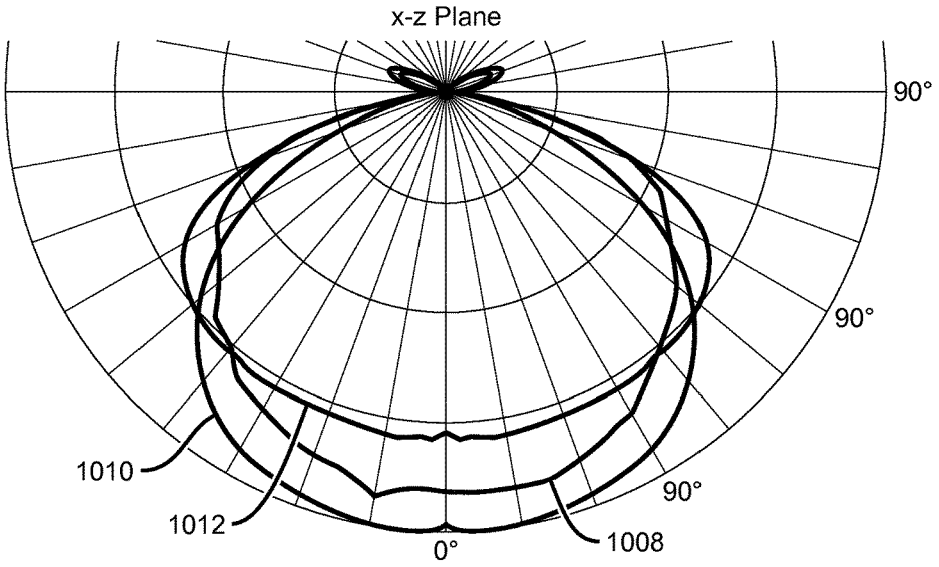
FIG. 11
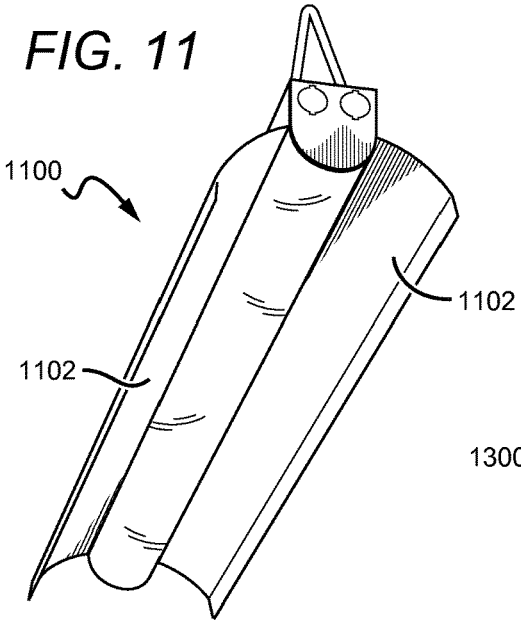
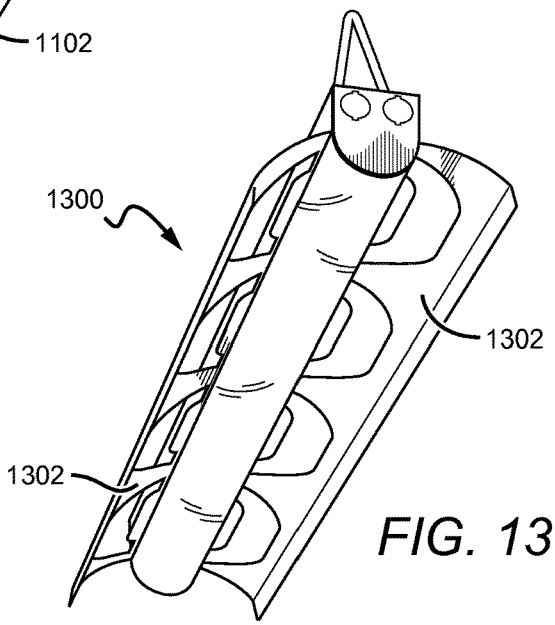
FIG. 13

FIG. 10c

Fixture 900

Zonal Lumen Summary

| Zone | Lumens | %Lamp | %Fixt |
|---|---|---|---|
| 0-20 | 487.15 | 48715.00 | 10.80 |
| 0-30 | 1041.14 | 104114.00 | 23.10 |
| 0-40 | 1721.22 | 172122.00 | 38.30 |
| 0-60 | 3147.91 | 314791.00 | 70.00 |
| 0-80 | 4142.13 | 414213.00 | 92.10 |
| 0-90 | 4250.33 | 425033.00 | 94.50 |
| 10-90 | 4125.29 | 412529.00 | 91.70 |
| 20-40 | 1234.07 | 123407.00 | 27.40 |
| 20-50 | 1961.54 | 196154.00 | 43.60 |
| 40-70 | 2027.62 | 202762.00 | 45.10 |
| 60-80 | 994.22 | 99422.00 | 22.10 |
| 70-80 | 393.29 | 39329.00 | 8.70 |
| 80-90 | 108.21 | 10821.00 | 2.40 |
| 90-110 | 116.86 | 11686.00 | 2.60 |
| 90-120 | 187.54 | 18754.00 | 4.20 |
| 90-130 | 226.66 | 22666.00 | 5.00 |
| 90-150 | 248.23 | 24823.00 | 5.50 |
| 90-180 | 249.31 | 24931.00 | 5.50 |
| 110-180 | 132.45 | 13245.00 | 2.90 |
| 0-180 | 4499.65 | 449965.00 | 100.00 |

Industrial Flourescent Strip

Zonal Lumen Summary

| Zone | Lumens | %Lamp | %Fixt |
|---|---|---|---|
| 0-20 | 417.24 | 41724.00 | 9.30 |
| 0-30 | 905.78 | 90578.00 | 20.10 |
| 0-40 | 1533.38 | 153338.00 | 34.10 |
| 0-60 | 2997.3 | 299730.00 | 66.60 |
| 0-80 | 4092.64 | 409264.00 | 91.00 |
| 0-90 | 4186.45 | 418645.00 | 93.00 |
| 10-90 | 4080.02 | 408002.00 | 90.70 |
| 20-40 | 1116.14 | 111614.00 | 24.80 |
| 20-50 | 1833.3 | 183330.00 | 40.70 |
| 40-70 | 2138.62 | 213862.00 | 47.50 |
| 60-80 | 1095.34 | 108534.00 | 24.30 |
| 70-80 | 420.64 | 42064.00 | 9.30 |
| 80-90 | 93.81 | 93B1.00 | 2.10 |
| 90-110 | 163.55 | 16355.00 | 3.60 |
| 90-120 | 249.46 | 24946.00 | 5.50 |
| 90-130 | 295.47 | 29547.00 | 6.60 |
| 90-150 | 313.07 | 31307.00 | 7.00 |
| 90-180 | 313.23 | 31323.00 | 7.00 |
| 110-180 | 149.69 | 14969.00 | 3.30 |
| 0-180 | 4499.68 | 449968.00 | 100.00 |

Cree CS18 LED Linear Luminare

Zonal Lumen Summary

| Zone | Lumens | %Lamp | %Fixt |
|---|---|---|---|
| 0-20 | 524.72 | 52472.00 | 11 .70 |
| 0-30 | 1134.49 | 113449.00 | 25.20 |
| 0-40 | 1902.05 | 190205.00 | 42.30 |
| 0-60 | 3527.76 | 352776.00 | 78.40 |
| 0-80 | 4420.75 | 442075.00 | 98.20 |
| 0-90 | 4500.47 | 450047.00 | 100.00 |
| 10-90 | 4366.27 | 436627.00 | 97.00 |
| 20-40 | 1377.33 | 137733.00 | 30.60 |
| 20-50 | 2214.42 | 221442.00 | 49.20 |
| 40-70 | 2221.59 | 222159.00 | 49.40 |
| 60-80 | 892.99 | 89299.00 | 19.80 |
| 70-80 | 297.12 | 29712.00 | 6.60 |
| 80-90 | 79.72 | 7972.00 | 1.80 |
| 90-110 | 0.00 | 0.00 | 0.00 |
| 90-120 | 0.00 | 0.00 | 0.00 |
| 90-130 | 0.00 | 0.00 | 0.00 |
| 90-150 | 0.00 | 0.00 | 0.00 |
| 90-180 | 0.00 | 0.00 | 0.00 |
| 110-180 | 0.00 | 0.00 | 0.00 |
| 0-180 | 4500.47 | 450047.00 | 100.00 |

FIG. 12c

Fixture 1100

Zonal Lumen Summary

| Zone | Lumens | %Lamp | %Fixt |
|---|---|---|---|
| 0-20 | 556.66 | 55666.00 | 12.40 |
| 0-30 | 1188.42 | 118842.00 | 26.40 |
| 0-40 | 1959.93 | 195993.00 | 43.50 |
| 0-60 | 3549.74 | 354974.00 | 78.80 |
| 0-80 | 4431.62 | 443162.00 | 98.40 |
| 0-90 | 4496.41 | 449641.00 | 99.90 |
| 10-90 | 4353.5 | 435350.00 | 96.70 |
| 20-40 | 1403.27 | 140327.00 | 31.20 |
| 20-50 | 2222.01 | 222201.00 | 49.30 |
| 40-70 | 2179.82 | 217982.00 | 48.40 |
| 60-80 | 881.88 | 88188.00 | 19.60 |
| 70-80 | 291.88 | 29188.00 | 6.50 |
| 80-90 | 64.79 | 6479.00 | 1.40 |
| 90-110 | 4.32 | 432.00 | 0.10 |
| 90-120 | 4.79 | 479.00 | 0.10 |
| 90-130 | 5.17 | 517.00 | 0.10 |
| 90-150 | 5.79 | 579.00 | 0.10 |
| 90-180 | 6.26 | 626.00 | 0.10 |
| 110-180 | 1.94 | 194.00 | 0.00 |
| 0-180 | 4502.67 | 450267.00 | 100.00 |

FIG. 14c

Fixture 1300

Zonal Lumen Summary

| Zone | Lumens | %Lamp | %Fixt |
|---|---|---|---|
| 0-20 | 534.59 | 53459.00 | 11.90 |
| 0-30 | 1140.18 | 114018.00 | 25.30 |
| 0-40 | 1879.45 | 187945.00 | 41.80 |
| 0-60 | 3410.49 | 341049.00 | 75.80 |
| 0-80 | 4270.52 | 427052.00 | 94.90 |
| 0-90 | 4356.91 | 435691.00 | 96.90 |
| 10-90 | 4219.58 | 421958.00 | 93.80 |
| 20-40 | 1344.87 | 134487.00 | 29.90 |
| 20-50 | 2131.99 | 213199.00 | 47.40 |
| 40-70 | 2102.27 | 210227.00 | 46.70 |
| 60-80 | 860.03 | 86003.00 | 19.10 |
| 70-80 | 288.79 | 28879.00 | 6.40 |
| 80-90 | 86.39 | 8639.00 | 1.90 |
| 90-110 | 106.70 | 10670.00 | 2.40 |
| 90-120 | 130.09 | 13009.00 | 2.90 |
| 90-130 | 136.37 | 13637.00 | 3.00 |
| 90-150 | 140.23 | 14023.00 | 3.10 |
| 90-180 | 141.24 | 14124.00 | 3.10 |
| 110-180 | 34.54 | 3454.00 | 0.80 |
| 0-180 | 4498.15 | 449815.00 | 100.00 |

Fixture 1500

Zonal Lumen Summary

| Zone | Lumens | %Lamp | %Fixt |
|---|---|---|---|
| 0-20 | 499.30 | 49930.00 | 11.10 |
| 0-30 | 1063.42 | 106342.00 | 23.60 |
| 0-40 | 1752.07 | 175207.00 | 38.90 |
| 0-60 | 3189.66 | 318966.00 | 70.80 |
| 0-80 | 4018.55 | 401855.00 | 89.20 |
| 0-90 | 4152.6 | 415260.00 | 92.20 |
| 10-90 | 4024.19 | 402419.00 | 89.30 |
| 20-40 | 1252.77 | 125277.00 | 27.80 |
| 20-50 | 1989.3 | 198930.00 | 44.20 |
| 40-70 | 1979.15 | 197915.00 | 43.90 |
| 60-80 | 828.89 | 82889.00 | 18.40 |
| 70-80 | 287.33 | 28733.00 | 6.40 |
| 80-90 | 134.05 | 13405.00 | 3.00 |
| 90-110 | 257.59 | 25759.00 | 5.70 |
| 90-120 | 318.59 | 31859.00 | 7.10 |
| 90-130 | 343.45 | 34345.00 | 7.60 |
| 90-150 | 350.52 | 35052.00 | 7.80 |
| 90-180 | 351.73 | 35173.00 | 7.80 |
| 110-180 | 94.14 | 9414.00 | 2.10 |
| 0-180 | 4504.33 | 450433.00 | 100.00 |

Fixture 1700

Zonal Lumen Summary

| Zone | Lumens | %Lamp | %Fixt |
|---|---|---|---|
| 0-20 | 487.15 | 48715.00 | 10.80 |
| 0-30 | 1041.14 | 104114.00 | 23.10 |
| 0-40 | 1721.22 | 172122.00 | 38.30 |
| 0-60 | 3147.91 | 314791.00 | 70.00 |
| 0-80 | 4142.13 | 414213.00 | 92.10 |
| 0-90 | 4250.33 | 425033.00 | 94.50 |
| 10-90 | 4125.29 | 412529.00 | 91.70 |
| 20-40 | 1234.07 | 123407.00 | 27.40 |
| 20-50 | 1961.54 | 196154.00 | 43.60 |
| 40-70 | 2027.62 | 202762.00 | 45.10 |
| 60-80 | 994.22 | 99422.00 | 22.10 |
| 70-80 | 393.29 | 39329.00 | 8.70 |
| 80-90 | 108.21 | 10821.00 | 2.40 |
| 90-110 | 116.86 | 11686.00 | 2.60 |
| 90-120 | 187.54 | 18754.00 | 4.20 |
| 90-130 | 226.66 | 22666.00 | 5.00 |
| 90-150 | 248.23 | 24823.00 | 5.50 |
| 90-180 | 249.31 | 24931.00 | 5.50 |
| 110-180 | 132.45 | 13245.00 | 2.90 |
| 0-180 | 4499.65 | 449965.00 | 100.00 |

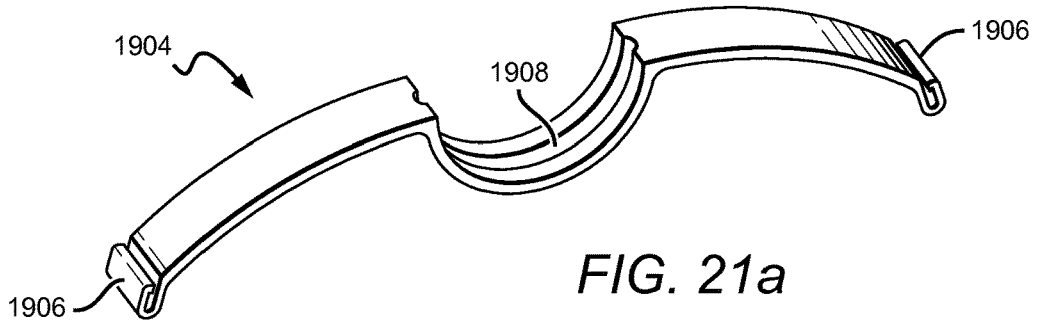
FIG. 21a
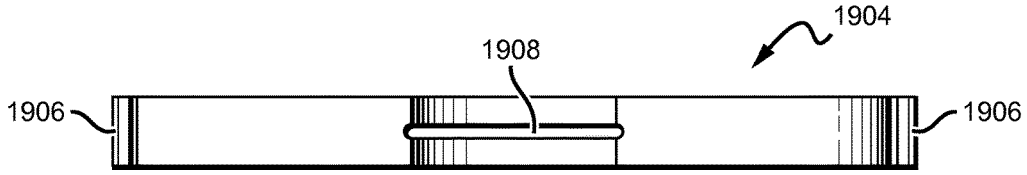
FIG. 21b
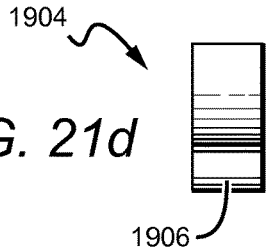
FIG. 21d
FIG. 21c
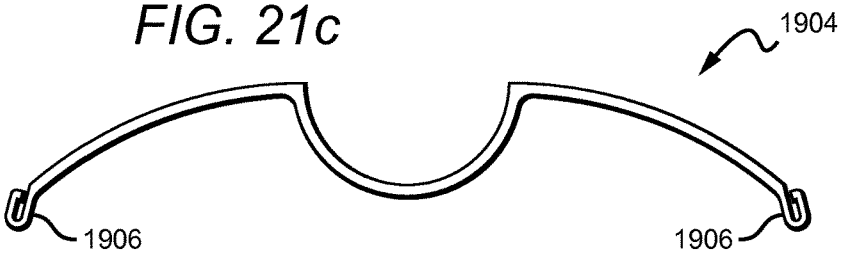

LINEAR SHELF LIGHT FIXTURE WITH REFLECTORS

RELATED APPLICATIONS

This application is a continuation-in-part of U.S. patent application Ser. No. 14/108,168, filed on 16 Dec. 2013. The application referenced in this paragraph is incorporated by reference as if set forth fully herein.

BACKGROUND OF THE INVENTION

Field of the Invention

The invention relates to lighting fixtures and, more particularly, to linear lighting fixtures that are well-suited for use with solid state lighting sources, such as light emitting diodes (LEDs).

Description of the Related Art

Troffer-style fixtures (troffers) are ubiquitous in commercial office and industrial spaces throughout the world. In many instances these troffers house elongated fluorescent light bulbs that span the length of the troffer. Troffers may be mounted to or suspended from ceilings or walls. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that which often extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

One embodiment of light fixture comprises the following elements. An elongated base comprises end panels at both ends. A light engine is removably fastened to the base. At least one elongated reflector extends away from the base such that at least some light emitted from the light engine impinges on the reflector and is redirected in a primary emission direction.

An embodiment of a light device comprises the following elements. A plurality of light fixtures are connected in a serial arrangement, with each of said light fixtures comprising: an elongated base comprising end panels at both ends; a light engine removably fastened to the base; and at least one elongated reflector extending away from the base. A joiner joins consecutive ends of the light fixtures in the serial arrangement.

A joiner device comprises the following elements. An elongated body is shaped to conform to a surface of adjacent structures. Fasteners on both ends of the body removably attach the body to the adjacent structures. A groove in the body is sized to receive a protruding portion of the adjacent structures such that the adjacent structures are aligned when the protruding portions are inserted into the groove.

BRIEF DESCRIPTION OF THE DRAWINGS

FIGS. 5*a* and 5*b* are perspective views of a gap filler element according to an embodiment of the present invention.

FIGS. 5*c-f* are various elevation views of a gap filler element according to an embodiment of the present invention (5*c*: right end elevation; 5*d*: bottom elevation; 5*e*: right side elevation; and 5*f*: top elevation).

FIG. 6 is a perspective view of a portion of a linear light fixture according to an embodiment of the present invention.

FIGS. 7*a* and 7*b* are polar graphs showing radiant intensity (W/sr) versus viewing angle (degrees) of light fixtures. FIG. 7*c* shows zonal lumen summaries for these fixtures.

FIG. 8*a* is a bottom perspective view of a linear light fixture according to an embodiment of the present invention. FIG. 8*b* is a top perspective view of the fixture. FIG. 8*c* is a right end elevation view of the fixture.

FIG. 9 is a bottom perspective view of a linear light fixture with reflectors according to an embodiment of the present invention.

FIGS. 10*a* and 10*b* are polar graphs showing radiant intensity (W/sr) versus viewing angle (degrees) of a simulated light fixture according to an embodiment of the present invention compared with existing fixtures. FIG. 10*c* shows zonal lumen summaries for these fixtures.

FIG. 11 is a bottom perspective view of a linear light fixture with reflectors according to an embodiment of the present invention.

FIG. 12*c* shows a zonal lumen summary for the fixture.

FIG. 13 is a bottom perspective view of a linear light fixture with reflectors according to an embodiment of the present invention.

FIG. 14*c* shows a zonal lumen summary for the simulated fixture.

FIGS. 21*a-d* are various views of a joiner according to an embodiment of the present invention.

DETAILED DESCRIPTION OF THE INVENTION

Figure 1:
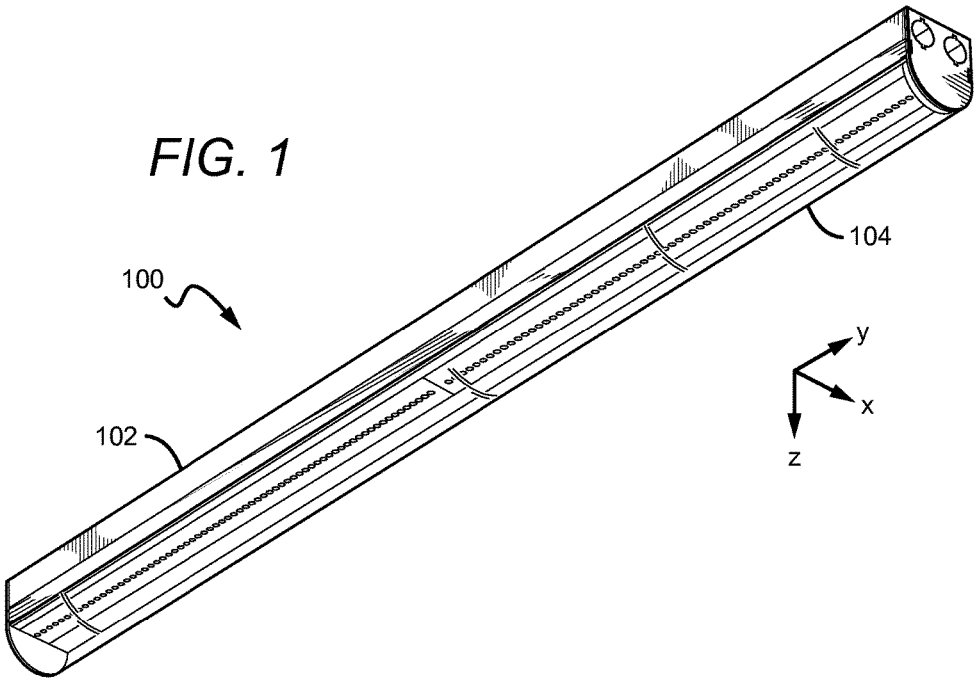
FIG. 1 is a bottom perspective view of a linear light fixture according to an embodiment of the present invention.

Embodiments of the present invention provide linear light fixture that is particularly well-suited for use with solid state light sources, such as LEDs, to provide a surface ambient light (SAL). The fixture comprises two primary structural components: a base and a light engine. These two subassemblies may be removably attached to operate as a singular fixture. The base comprises a body with end panels at both ends and is mountable to an external structure. The light engine comprises the light sources, an elongated lens, and any other optical elements that tailor the outgoing light to a particular profile. A gap filler element is disposed between the light engine and the end panels at one or both ends of the base to fill the space between those elements, giving the appearance that the light engine extends continuously to the end panel and eliminating direct imaging of the light sources outside the fixture. Electronics necessary to power and control the light sources may be disposed in either the base or the light engine. External reflectors may also be included to further shape the output beam.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "emitter" can be used to indicate a single light source or more than one light source functioning as a single emitter. For example, the term may be used to describe a single blue LED, or it may be used to describe a red LED and a green LED in proximity emitting as a single source. Additionally, the term "emitter" may indicate a single LED chip or multiple LED chips arranged in an array, for example. Thus, the terms "source" and "emitter" should not be construed as a limitation indicating either a single-element or a multi-element configuration unless clearly stated otherwise. Indeed, in many instances the terms "source" and "emitter" may be used interchangeably. It is also understood that an emitter may be any device that emits light, including but not limited to LEDs, vertical-cavity surface-emitting lasers (VCSELs), and the like.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional and/or cutaway views that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

FIG. 1 is a perspective view of a linear light fixture 100 according to an embodiment of the present invention. The fixture 100 is particularly well-suited for use with solid state light emitters, such as LEDs or vertical cavity surface emitting lasers (VCSELs), for example. However, other kinds of light sources may also be used. The elongated fixture 100 comprises a base 102 and a light engine 104. The two subassemblies 102, 104 are removably attached as shown. When assembled, the base 102 and the light engine 104 define an internal cavity that houses several elements including the light sources and the driver electronics as shown in detail herein. The base 102 is designed to work with different light engine subassemblies such that they may be easily replaced to achieve a particular lighting effect, for example.

Figure 2:
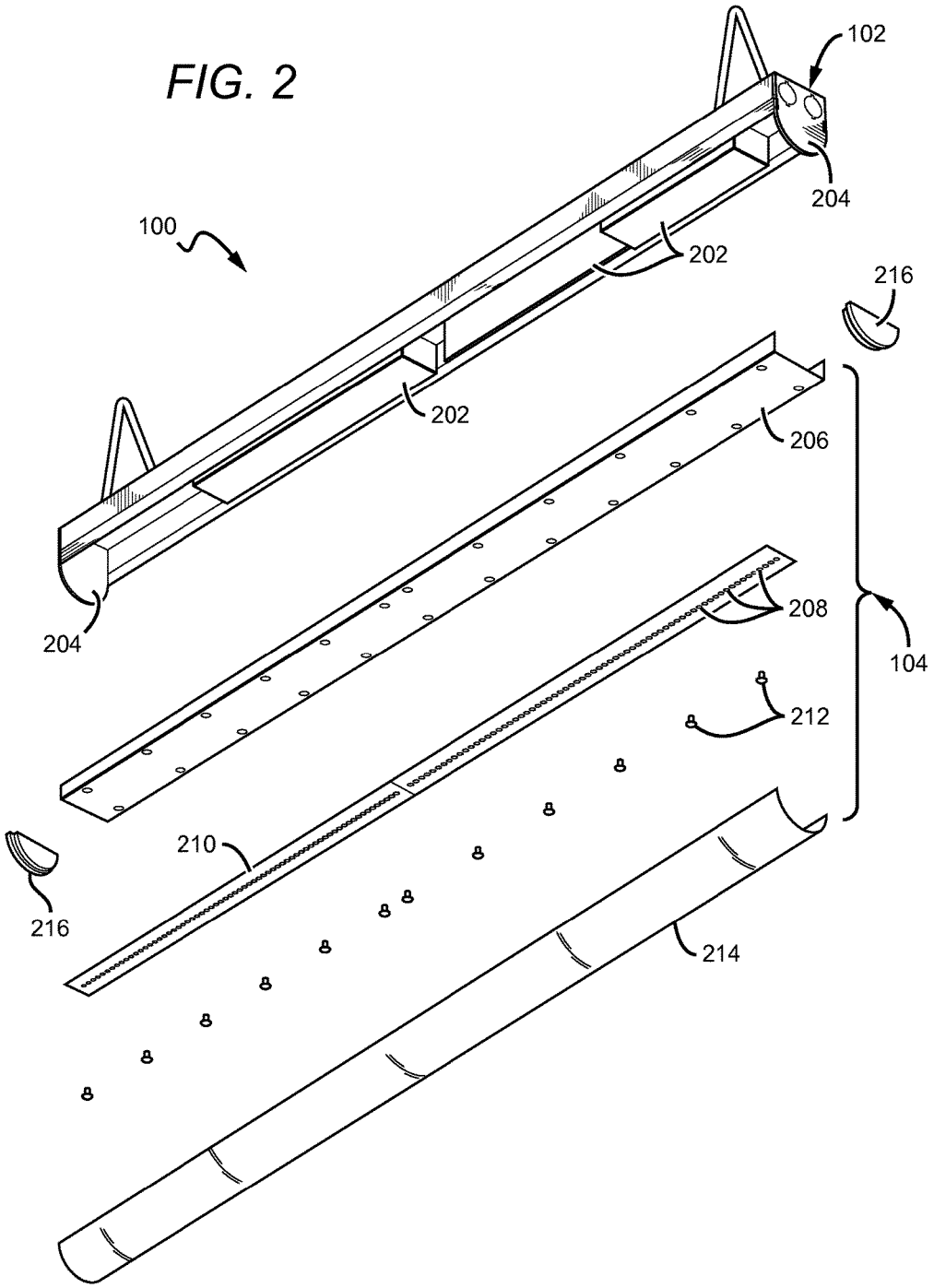
FIG. 2 is an exploded view of a linear light fixture according to an embodiment of the present invention.
Figures 3A, 3B, 3C, 3D:
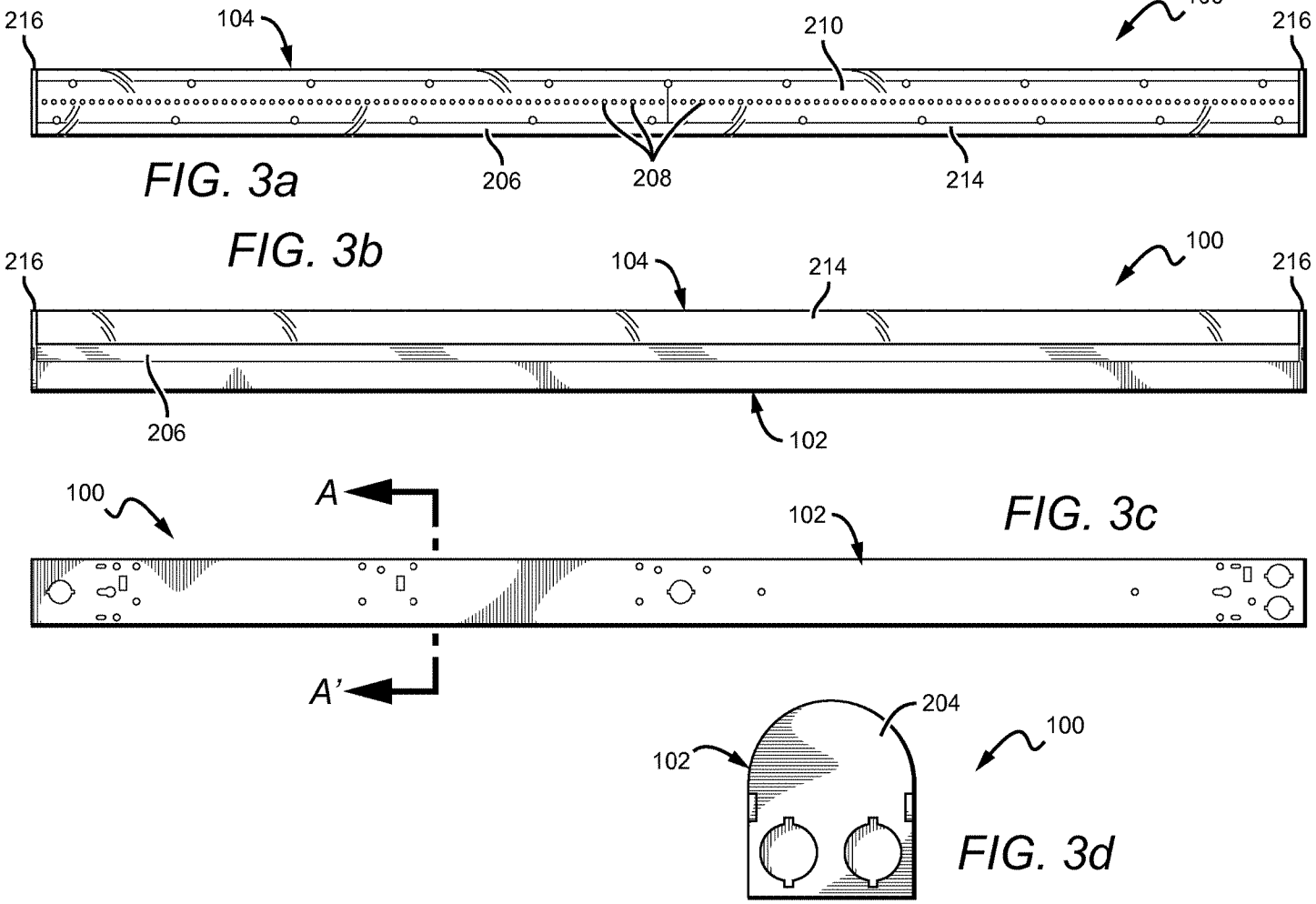
FIGS. 3*a-d* are various elevation views of a linear light fixture according to an embodiment of the present invention (3*a*: bottom elevation; 3*b*: right side elevation; 3*c*: top elevation; and 3*d*: right end elevation).

FIG. 2 is an exploded view of the fixture 100. FIGS. 3*a-d* provide several different elevation views of the fixture 100. FIG. 3*a* is a bottom elevation view; FIG. 3*b* is a is a right side perspective view, with the left side view being identical; FIG. 3*c* is top elevation view; FIG. 3*d* is a right end view, with the left end being view being identical.

With reference to FIGS. 2 and 3*a-d*, the elongated base 102 forms the primary structural body of the fixture 100. In this embodiment, driver electronics 202 are mounted on an interior surface within the base 102. The base 102 also comprises two integral end panels 204 on both ends. The light engine 104 comprises a mount plate 206 as the primary structural component. The mount plate 206 provides a flat surface on which a plurality of light sources 208 may be mounted. Here, the light sources 208 are disposed on a pre-fabricated light strip 210 which is mounted to the mount plate 206 with, e.g., screws 212 or other fastening means. An elongated lens 214 is attached to the mount plate 206 and covers the light sources 208. The lens 214 performs a dual function; it both protects components within the internal cavity and shapes and/or diffuses the outgoing light. When assembled, in this embodiment, gap filler elements 216 are arranged between both end panels 204 of the base 102 and the ends of the light engine 104. In other embodiments, a single gap filler element may be used at one end of the fixture. Gap filler elements are discussed in more detail herein.

This particular embodiment features mount brackets 218 that may be used to mount the fixture 100 to a ceiling or a T-grid, for example. The fixture 100 can be mounted in many different ways. For example, it can be surface mounted to a wall, a ceiling, or another surface, or it can be suspended from the ceiling with aircraft cable or in a pendant configuration.

As shown in FIG. 3*c*, the top side of the fixture 100 may include various screw holes and knockouts to accommodate internally mounted driver electronics, for example. Similarly, as shown in FIG. 3*d*, knockouts the ends of the base 102 may also comprise knockouts to provide access to internal components. A person of skill will appreciate that screw holes, slots, knockouts, etc. may be arranged on the base 102 in various places to accommodate internal and external components as necessary.

Figure 4:
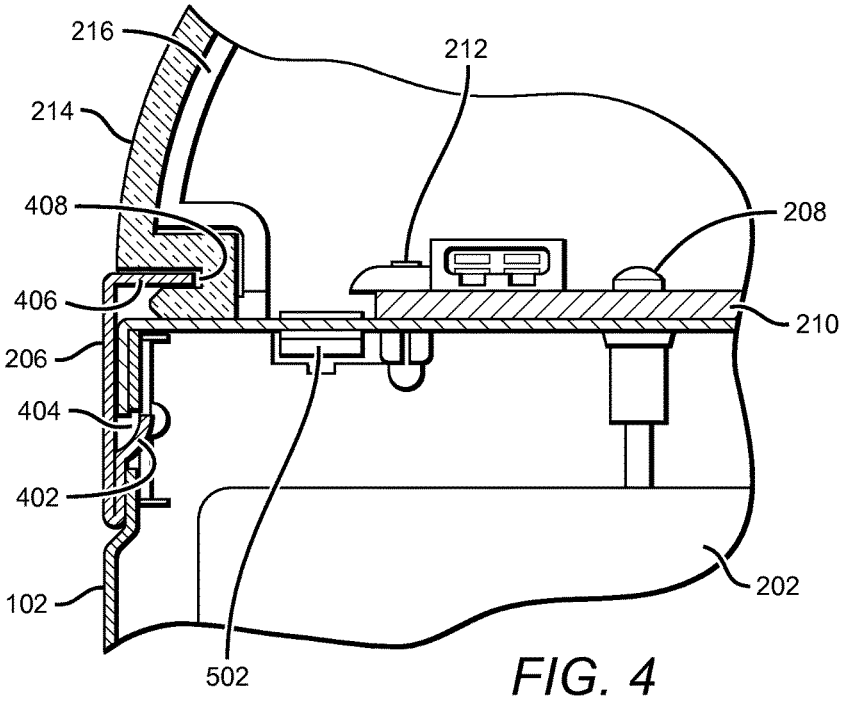
FIG. 4 is a close-up cutaway view (along cut line A-A') of a portion of a linear light fixture according to an embodiment of the present invention.

FIG. 4 is a close-up cutaway side view of the fixture along cut line A-A'. The electronic components 202 are mounted on the interior of the base 102 along the longitudinal axis. The mount plate 206 comprises tabs 402 that mate with slots 404 in the base to removably attach the two components base 102 and the light engine 104. The base 102 can receive many different light engines to provide a fixture having a desired optical effect and also to facilitate replacement if a light engine is damaged or otherwise malfunctions. Thus, the base 102 functions as a universal receiving structure for various embodiments of light engines. The mount plate 206 bends back on itself to form a flange 406, and the lens 214 is shaped to define a longitudinal groove 408. The groove 408 receives the flange 406 to align the lens with the mount plate 206 and to hold them together, forming the light engine 104. Also visible is the gap filler tab 502 which protrudes through the mount plate 206, allowing the gap filler 216 to be removably fastened to the light engine 104 as described in more detail herein.

One challenge associated with the fabrication of linear fixtures is the availability of lenses that are uniformly cut to a specific length. It is often desirable to use an extrusion process to produce the lenses; however, such a process does not provide precise tolerances in the length of the lenses, especially for longer models. If a lens that is shorter than the specified length, there will be a gap between the lens and the base at one or both ends of the fixture. This can lead to imaging of the light sources external to the fixture. Embodiments of the present invention comprise the gap filler elements 216 to account for these gaps. The gap fillers 216 fill the space with a translucent material that gives the appearance that the light engine 104 extends all the way to the end panel 204 of the base 102. Because the light sources 208 are no long visible through the gaps, source imaging is eliminated. The gap fillers 216 compensate for inconsistency in lens manufacturing, allowing for a much more relaxed tolerance for lens length.

FIGS. 5*a-f* show several views of a gap filler element 216 according to an embodiment of the present invention. FIG. 5*a* is front perspective view; FIG. 5*b* is a back side perspective view; FIG. 5*c* is a front elevation view; FIG. 5*d* is a top elevation view; FIG. 5*e* is a side elevation view; and FIG. 5*f* is a bottom elevation view.

The gap filler 216 is removably attachable to the light engine 104 such that, when assembled, the gap filler 216 is interposed between the end panel 204 of the base 102 and the end of light engine 104. The gap filler 216 comprises tabs 502 that snap-fit into corresponding slots on the mount plate 206, fastening the gap filler 216 to the light engine 104. The snap-fit fastening mechanism allows for easier and faster assembly without the need for screws or adhesives.

The gap filler 216 also comprises a spacer portion 504 and a ridge 506. The spacer portion 504 is shaped to mimic the external contour of the lens 214 such that the lens 214 appears to extend continuously to the end panel 204. The ridge 506 protrudes from said spacer portion 504 and is shaped to conform to an interior surface of the lens 214. During assembly the ridge slides under the lens with the tabs 502 engaging slots in the mount plate 206 for a snap fit. The width of the ridge 506 is designed to compensate for a maximum deviation from length specification, with a wider ridge allowing for a more relaxed tolerance.

The gap fillers 216 comprise a light-transmissive (e.g., translucent) material. The material should diffuse the light sufficiently to prevent source imaging with the optimal diffusion providing an output that is similar in appearance to that emitted from the lens 214. In some embodiments, the gap filler 216 does not need to be as diffusive as the lens 214 because most of the light that exits the gap filler 216 will exit from its edge. Some suitable materials include polycarbonates or acrylics.

FIG. 6 is a close-up perspective view of the fixture 100, fully assembled. The gap filler 216 is interposed between the end panel 204 of the base 102 and the lens 214 of the light engine 104. The gap filler ridge 506 fits just under the lens 214 with the tabs 502 snap-fitting into the mount plate 206. The spacer portion 504 fills most of the gap between the lens 214 and the end panel 204, giving the fixture 100 a fully luminous appearance all the way to the end panels 204. As noted, gap fillers 216 can be used at one or both ends of a fixture.

In one embodiment the driver electronics 202 comprise a step-down converter, a driver circuit, and a battery backup. At the most basic level a driver circuit may comprise an AC/DC converter, a DC/DC converter, or both. In one embodiment, the driver circuit comprises an AC/DC converter and a DC/DC converter both of which are located in the base 102. In another embodiment, the AC/DC conversion is done in the base 102, and the DC/DC conversion is done in the light engine 104. Another embodiment uses the opposite configuration where the DC/DC conversion is done in the base 102, and the AC/DC conversion is done in the light engine 104. In yet another embodiment, both the AC/DC converter and the DC/DC converter are located in the light engine 104. It is understood that the various electronic components may distributed in different ways in one or both of the base 102 and the light engine 104.

In one embodiment, the lens 214 comprises a diffusive element. A diffusive exit lens 214 functions in several ways. For example, it can prevent direct visibility of the sources and provide additional mixing of the outgoing light to achieve a visually pleasing uniform source. However, a diffusive exit lens can introduce additional optical loss into the system. Thus, in embodiments where the light is sufficiently mixed internally by other elements, a diffusive exit lens may be unnecessary. In such embodiments, a transparent exit lens may be used, or the exit lens may be removed entirely. In still other embodiments, scattering particles may be included in the exit lens 214.

Diffusive elements in the lens 214 can be achieved with several different structures. A diffusive film inlay can be applied to the top- or bottom-side surface of the lens 214. It is also possible to manufacture the lens 214 to include an integral diffusive layer, such as by coextruding the two materials or by insert molding the diffuser onto the exterior or interior surface. A clear lens may include a diffractive or repeated geometric pattern rolled into an extrusion or molded into the surface at the time of manufacture. In another embodiment, the exit lens material itself may comprise a volumetric diffuser, such as an added colorant or particles having a different index of refraction, for example.

In other embodiments, the lens 214 may be used to optically shape the outgoing beam with the use of microlens structures, for example. Microlens structures are discussed in detail in U.S. patent application Ser. No. 13/442,311 to Lu, et al., which is commonly assigned with the present application to CREE, INC. and incorporated by reference herein.

Several measurements were taken of various light engines and lenses according to various embodiments of the present invention. In addition, several simulations were performed to model the performance of the light engines and lenses and to compare with the measurements that were taken. All simulations referred to herein were created using the LightTools program from Optical Research Associates. LightTools is a software suite well-known in the lighting industry for producing reliable simulations that provide accurate predictions of performance in the real world. Measurements and simulations of the various embodiments discussed below include polar graphs showing radiant intensity (W/sr) versus viewing angle (degrees). The light sources used in actual fixtures are XH-G LEDs that are commercially available from Cree, Inc. Likewise, all simulations use sources that mimic the performance of XH-G LEDs. Those of skill in the art will understand that many different kinds of LEDs would work with the fixtures disclosed herein.

Figures 7B, 7C:
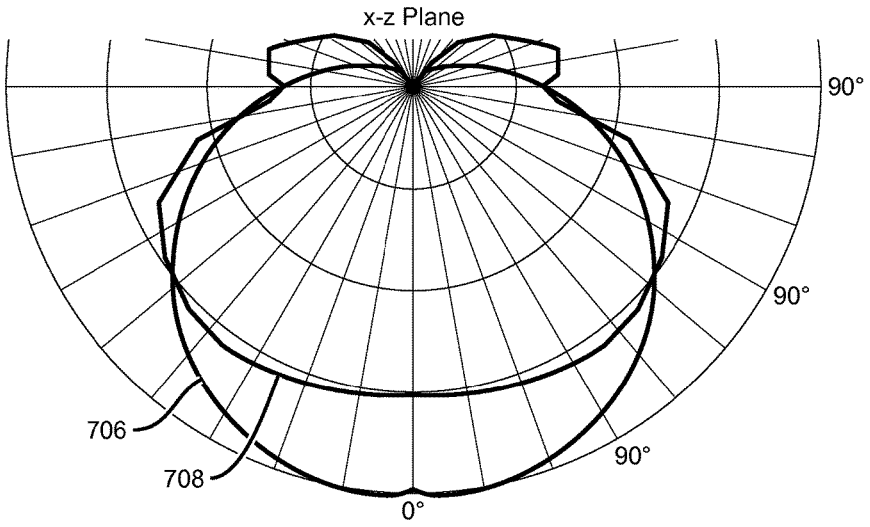

FIGS. 7*a* and 7*b* are polar graphs of measured radiant intensity (W/sr) over the entire range of viewing angles of the light fixture 100 compared with a standard 2-lamp fluorescent strip. Two data sets are represented on both graphs: the fixture 100 data sets 702, 706 and the data sets 704, 708 for the standard fluorescent strip, with both all data sets scaled to 4500 lumens. In FIG. 7*a*, the data sets 702, 704 illustrate radiant intensity coming from the fixtures as the viewing angle is swept from 0° to 360° along a longitudinal plane (y-z plane) down the center, with 0° representing the head-on view (i.e., directly in front of the light fixture on the lens side) and 180° representing the back side view (i.e., directly behind the light fixture from the base side). In FIG. 7*b*, the data sets 706, 708 show the radiant intensity coming from the fixtures as the viewing angle is swept from 0° to 360° along a transverse plane (x-z plane) through the center of one of the emitters. All of the polar graphs disclosed herein were generated with the same modeled measurement method. FIG. 7*c* provides zonal lumen summaries for the fixture 100 and the standard fluorescent strip.

In some embodiments, an elongated reflector can be included on one or both sides of the fixture to redirect light that is initially emitted at a high angle. FIG. 8*a* is a perspective view of a fixture 800 according to an embodiment of the present invention. The fixture 800 is similar to the fixture 100 except that the fixture 800 additionally comprises elongated reflectors 802 that extend away from the base 102 and run along the length of the fixture 800 on both sides. The reflectors may be shaped to define holes, louvres, perforations, and the like, as shown in exemplary embodiments disclosed herein. In some applications it is desirable to direct some light in both directions, for example, to light both a ceiling and the room beneath it. In this particular embodiment, the reflectors 802 comprise a plurality of louvres 804 which redirect some of the high angle light as uplight. The louvres 804 protrude down into the normal path of the light that exits the fixture such that a portion of it is captured and redirected by the louvres 804 through the reflector 802, providing uplight. The term uplight is used to describe light that illuminates an area that would normally considered to behind the intended direction of emission for the fixture, or opposite the primary emission direction of the fixture. For example, in ceiling-mounted or suspended fixtures, uplight refers to light from the fixture that illuminates the ceiling around the fixture. Many different sizes and shapes of holes may be cut into reflectors to provide a particular uplight profile. Similarly as in the fixture 800, the uplight can be provided using a combination of reflective structures and holes such as the louvres 804. Holes and louvres can be provided on one or both reflectors depending on the desired output profile.

FIG. 8*b* shows a top side perspective view of the fixture 800. FIG. 8*c* shows a right end elevation view of the fixture 800. The reflectors 802 can be attached to the fixture in several ways. Here, the reflectors 802 are attached to the top side of the base, using a snap-fit fasteners 806. The reflectors 802 comprise back side flanges 808 that provide a mounting means to the top of the fixture base. In this particular embodiment, a male snap-fit connector mates with a female connector cut into the fixture base to provide the snap-fit fastener 806.

The following exemplary embodiments feature fixtures similar to the fixture 100, each comprising a different reflector shaped and sized to provide a particular output profile.

FIG. 9 is a bottom side perspective view of a fixture 900 according to an embodiment of the present invention. The fixture 900 is similar to fixture 100 with the addition of wide solid reflectors 902 that extend away from the fixture body and run along the length of the fixture 900. The fixture 900 provides an output that is characterized by the data represented in FIGS. 10*a-c*.

FIGS. 10*a* and 10*b* are polar graphs of modeled radiant intensity (W/sr) over the entire range of viewing angles of a simulated fixture 900 compared with two other kinds of fixtures. Three data sets are represented on both graphs: the fixture 900 data sets 1002, 1008, the data sets 1004, 1010 for an industrial fluorescent strip, and the data sets 1006, 1012 for a CS18 LED Linear Luminaire (commercially available from Cree, Inc.; http://www.cree.com/Lighting/Products/Indoor/High-Low-Bay/CS18) with all data sets scaled to 4500 lumens. In FIG. 10*a*, the data sets 1002, 1004, 1006 illustrate radiant intensity along the y-z plane. In FIG. 10*b*, the data sets 1008, 1010, 1012 show the radiant intensity as the viewing angle is swept from 0° to 360° along the x-z plane. FIG. 10*c* provides zonal lumen summaries for the fixture 900, the industrial fluorescent strip, and the CS18 LED Linear Luminaire.

FIG. 11 is a bottom side perspective view of a fixture 1100 according to an embodiment of the present invention. The fixture 1100 is similar to fixture 100 with the addition of narrow solid reflectors 1102 that extend away from the fixture body and run along the length of the fixture 1100. The fixture 1100 provides an output that is characterized by the data represented in FIGS. 12*a-c*.

Figure 12A:
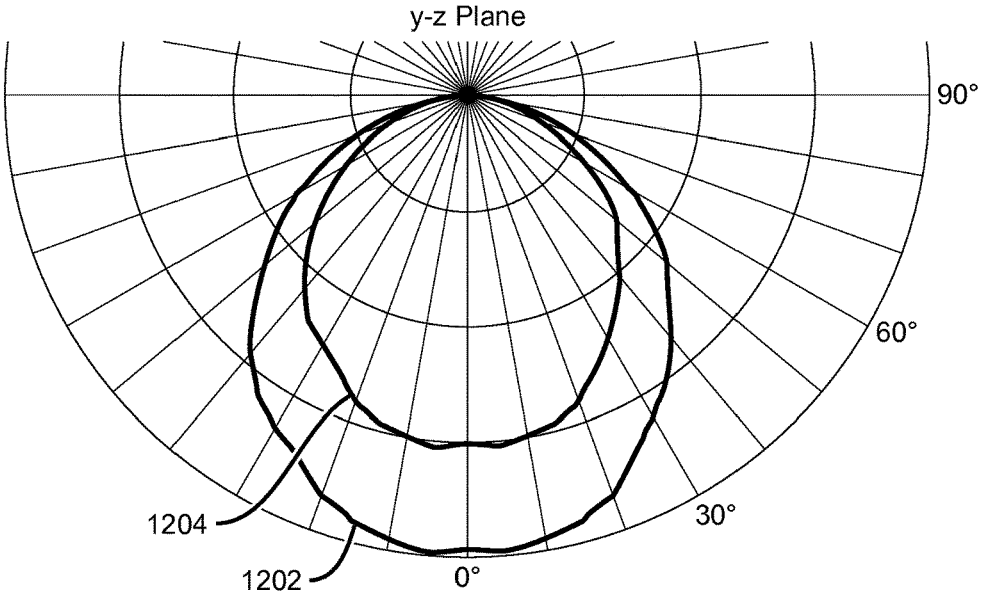
FIGS. 12*a* and 12*b* are polar graphs showing radiant intensity (W/sr) versus viewing angle (degrees) of simulated light fixtures.
Figure 12B:
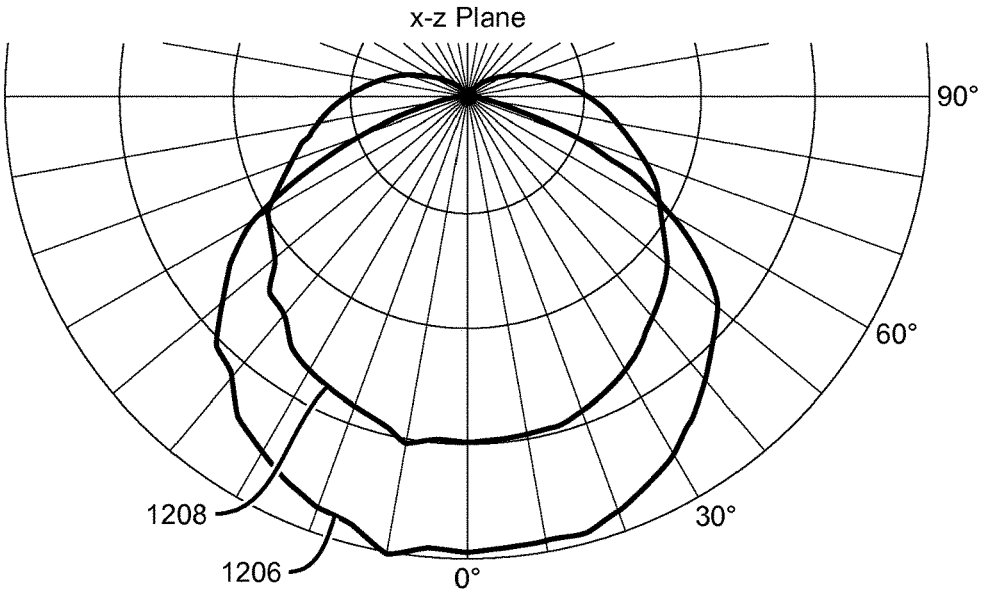

FIGS. 12*a* and 12*b* are polar graphs of modeled radiant intensity (W/sr) over the entire range of viewing angles of a simulated fixture 1100 compared with the simulated fixture 100. Two data sets are represented on both graphs: the fixture 1100 data sets 1202, 1206, the data sets 1204, 1208 for the fixture 100 without reflectors, with both data sets scaled to 4500 lumens. In FIG. 12*a*, the data sets 1202, 1204 illustrate radiant intensity along the y-z plane. In FIG. 12*b*, the data sets 1206, 1208 show the radiant intensity coming from the fixtures as the viewing angle is swept from 0° to 360° along the x-z plane. FIG. 12*c* provides zonal lumen summaries for the fixture 1100.

FIG. 13 is a bottom side perspective view of a fixture 1300 according to an embodiment of the present invention. The fixture 1300 is similar to fixture 100 with the addition of reflectors 1302 that extend away from the fixture body and run along the length of the fixture 1300. In this particular embodiment, the reflectors 1302 are shaped to define a plurality of crescent slots to allow for more uplight. The fixture 1300 provides an output that is characterized by the data represented in FIGS. 14*a-c*.

Figure 14A:
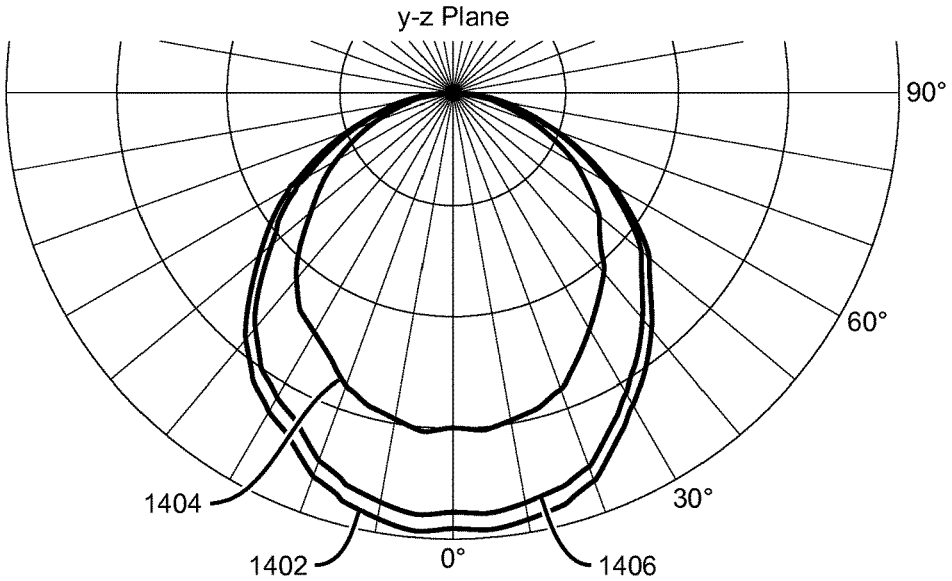
FIGS. 14*a* and 14*b* are polar graphs showing radiant intensity (W/sr) versus viewing angle (degrees) of a simulated light fixture according to an embodiment of the present invention compared with other simulated fixtures.
Figure 14B:
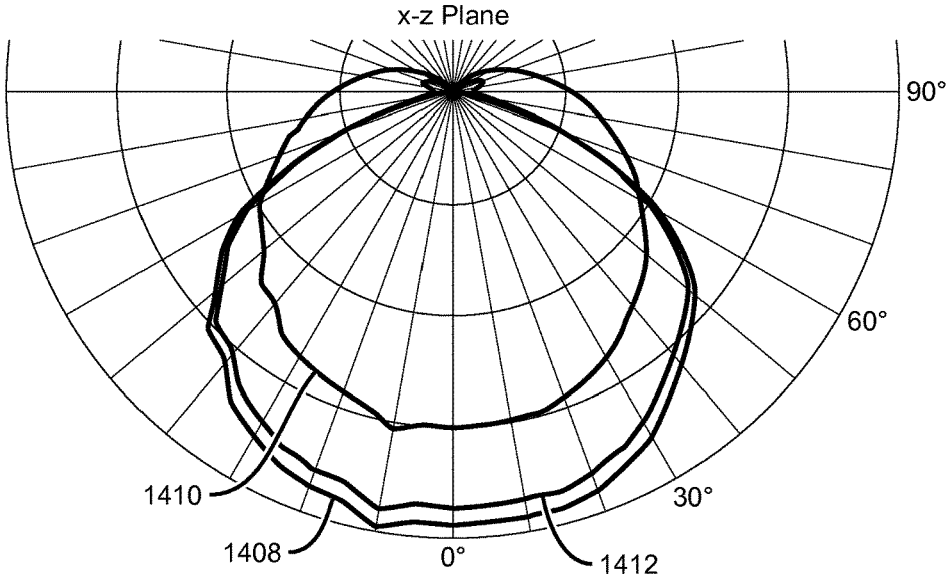

FIGS. 14*a* and 14*b* are polar graphs of modeled radiant intensity (W/sr) over the entire range of viewing angles of a simulated fixture 1300 compared with the simulated fixture 100 and the fixture 1100. Three data sets are represented on both graphs: the fixture 1300 data sets 1402, 1408, the data sets 1404, 1410 for the fixture 100 without reflectors, and the data sets for the fixture 1100, with all data sets scaled to 4500 lumens. In FIG. 14*a*, the data sets 1402, 1404, 1406 illustrate radiant intensity along the y-z plane. In FIG. 14*b*, the data sets 1408, 1410, 1412 show the radiant intensity coming from the light fixtures as the viewing angle is swept from 0° to 360° along the x-z plane. FIG. 14*c* provides zonal lumen summaries for the fixture 1300.

Figures 15, 16C:
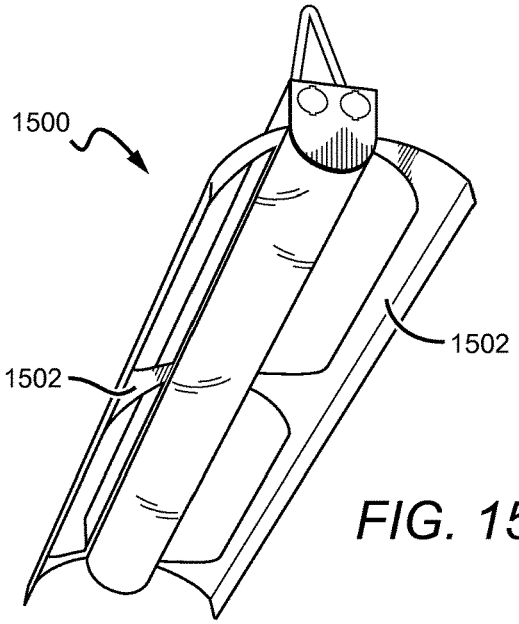
FIG. 15 is a bottom perspective view of a linear light fixture with reflectors according to an embodiment of the present invention.
FIG. 16*c* shows a zonal lumen summary for the simulated fixture.

FIG. 15 is a bottom side perspective view of a fixture 1500 according to an embodiment of the present invention. The fixture 1500 is similar to fixture 100 with the addition of reflectors 1502 that extend away from the fixture body and run along the length of the fixture 1500. In this particular embodiment, the reflectors 1502 are shaped to define a plurality of linear slots to allow for more uplight. The fixture 1500 provides an output that is characterized by the data represented in FIGS. 16*a-c*.

Figure 16A:
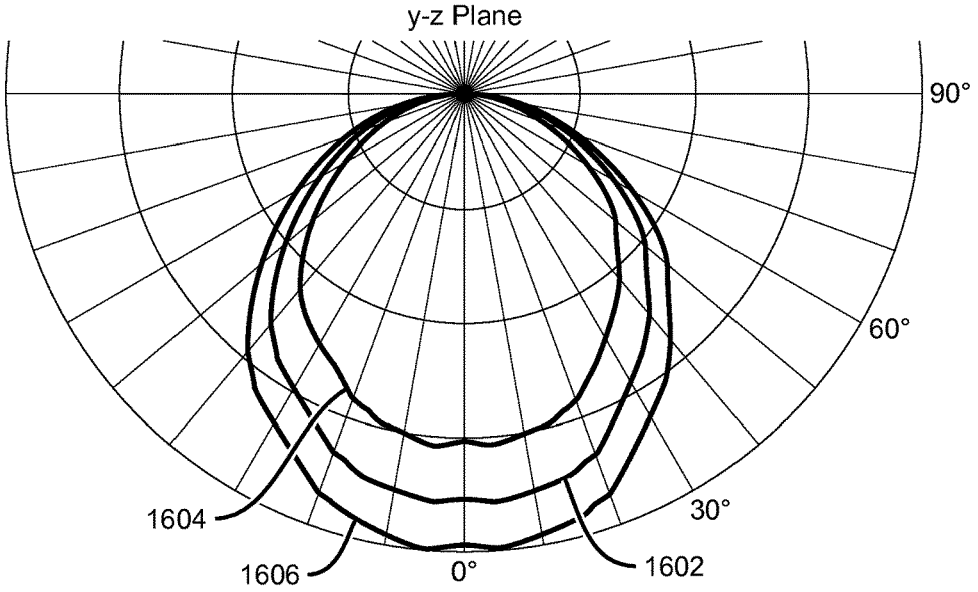
FIGS. 16*a* and 16*b* are polar graphs showing radiant intensity (W/sr) versus viewing angle (degrees) of a simulated light fixture according to an embodiment of the present invention compared with other simulated fixtures.
Figure 16B:
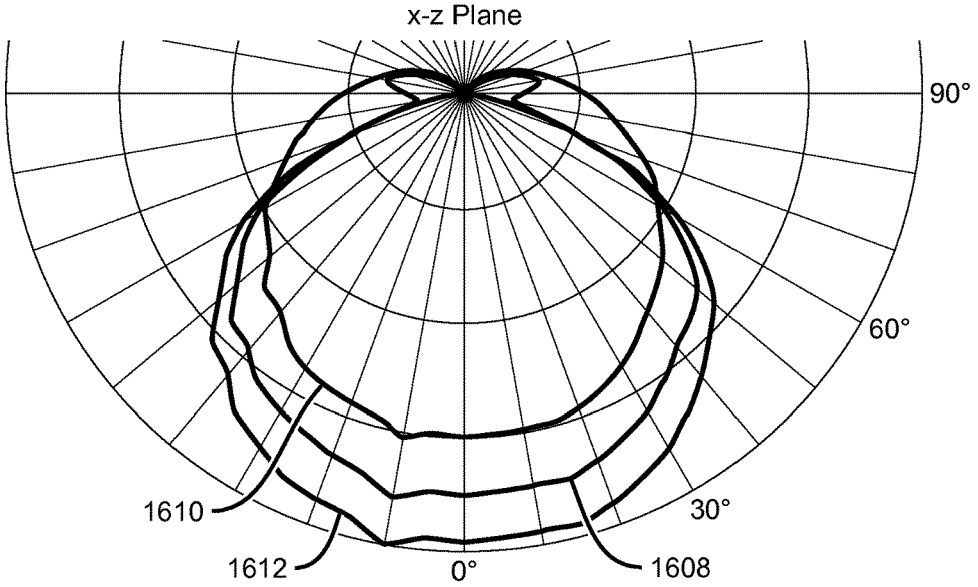

FIGS. 16*a* and 16*b* are polar graphs of modeled radiant intensity (W/sr) over the entire range of viewing angles of a simulated fixture 1500 compared with the simulated fixture 100 and the fixture 1100. Three data sets are represented on both graphs: the fixture 1500 data sets 1602, 1608, the data sets 1604, 1610 for the fixture 100 without reflectors, and the data sets 1606, 1612 for the fixture 1100, with all data sets scaled to 4500 lumens. In FIG. 16*a*, the data sets 1602, 1604, 1606 illustrate radiant intensity along the y-z plane. In FIG. 16*b*, the data sets 1608, 1610, 1612 show the radiant intensity coming from the light fixtures as the viewing angle is swept from 0° to 360° along the x-z plane. FIG. 16*c* provides zonal lumen summaries for the fixture 1500.

Figures 17, 18C:
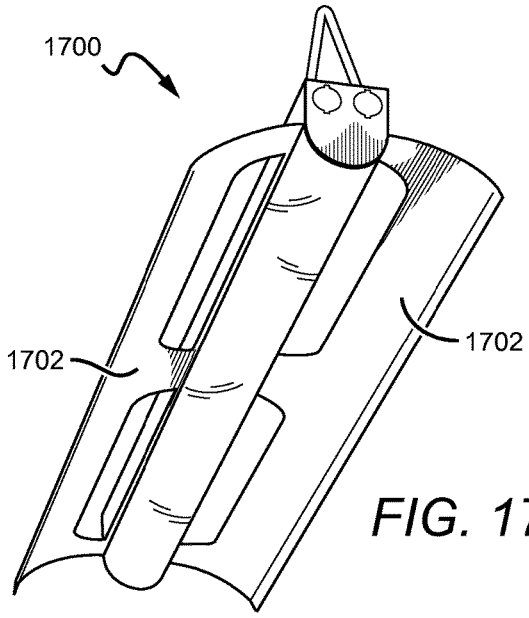
FIG. 17 is a bottom perspective view of a linear light fixture with reflectors according to an embodiment of the present invention.
FIG. 18*c* shows a zonal lumen summary for the simulated fixture.

FIG. 17 is a bottom side perspective view of a fixture 1700 according to an embodiment of the present invention. The fixture 1700 is similar to fixture 100 with the addition of reflectors 1702 that extend away from the fixture body and run along the length of the fixture 1700. In this particular embodiment, the reflectors 1702 are wider and shaped to define a plurality of linear slots to allow for more uplight. The fixture 1700 provides an output that is characterized by the data represented in FIGS. 18*a-c*.

Figure 18A:
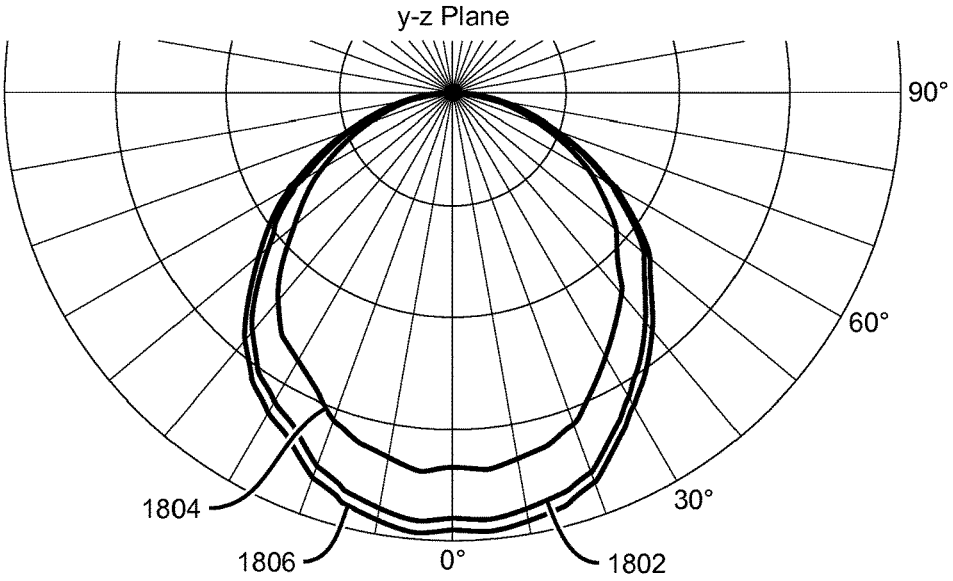
FIGS. 18*a* and 18*b* are polar graphs showing radiant intensity (W/sr) versus viewing angle (degrees) of a simulated light fixture according to an embodiment of the present invention compared with other simulated fixtures.
Figure 18B:
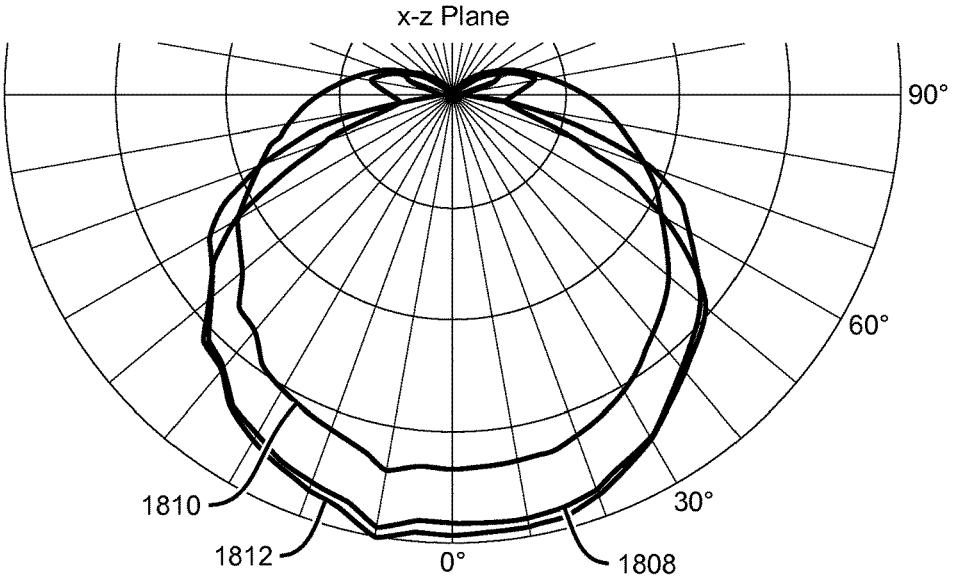

FIGS. 18*a* and 18*b* are polar graphs of modeled radiant intensity (W/sr) over the entire range of viewing angles of a simulated fixture 1700 compared with the simulated fixture 100 and the fixture 1100. Three data sets are represented on both graphs: the fixture 1700 data sets 1802, 1808, the data sets 1804, 1810 for the fixture 100 without reflectors, and the data sets 1806, 1812 for the fixture 1100, with all data sets scaled to 4500 lumens. In FIG. 18*a*, the data sets 1802, 1804, 1806 illustrate radiant intensity along the y-z plane. In FIG. 18*b*, the data sets 1808, 1810, 1812 show the radiant intensity coming from the light fixtures as the viewing angle is swept from 0° to 360° along the x-z plane. FIG. 18*c* provides zonal lumen summaries for the fixture 1700.

Figure 19:
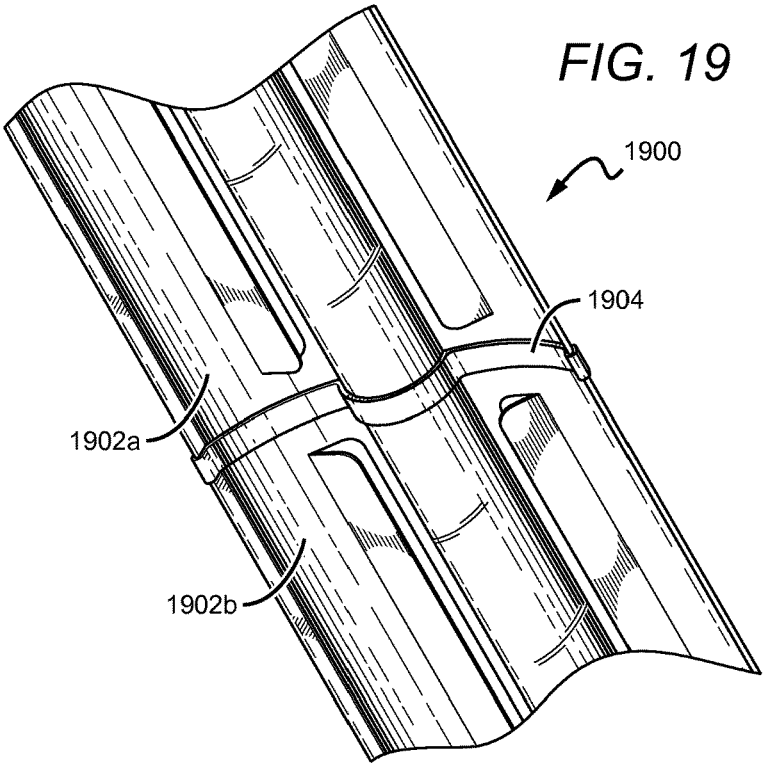
FIG. 19 is a close-up perspective view of a portion of a lighting device according to an embodiment of the present invention.

At least two fixtures according to embodiments of the present invention may be connected in a serial arrangement to provide multi-fixture configurations that appear as a single continuous system. Thus, fixtures may be shipped as individual units and assembled on site to the necessary length. FIG. 19 shows one such embodiment with a close-up perspective view of a portion of a lighting device 1900 comprising two adjacent fixtures 1902*a*, 1902*b* that are joined using a joiner 1904. In this particular embodiment the joiner 1904 spans the width of the fixtures 1902*a*, 1902*b* and is shaped to conform to the room-side surfaces of the reflectors and the light engine. The joiner 1904 covers the seam at the edges of the adjacent fixtures 1902*a*, 1902*b*, providing a substantially continuous appearance from one fixture to the next. In this embodiment, two fixtures 1902*a*, 1902*b* are connected in series; however, it is understood that many more fixtures can be similarly joined end-to-end (i.e., daisy-chained) to provide fixtures of any desired length. In addition, the fixtures may be curved such that the composite fixture can bend around a corner, for example.

Figure 20:
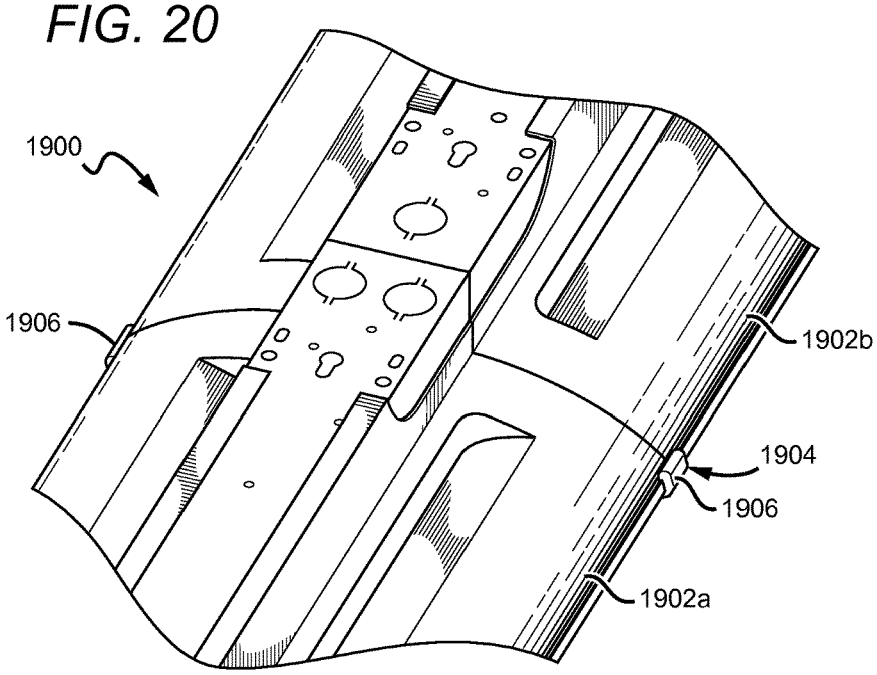
FIG. 20 is a close-up perspective view of the back side of a portion of a lighting device according to an embodiment of the present invention.

FIG. 20 is a close-up perspective view of a portion of the lighting device 1900. In this embodiment, the joiner is removably attached to the adjacent reflectors 1902*a*, 1902*b* with fasteners 1906 that snap-fit to the back side reflectors 1902*a*, 1902*b*. Here, the fasteners 1906 comprise clips that provide the snap-fit attachment, but it is understood that many other types of fasteners may be used, such as screws, pins, adhesives, and the like. In some embodiments, the joiner provides the primary mechanical support at the joint for the connection. In other embodiments, the primary mechanical support is provided through adjoining structures through the end panels such as a nipple, for example.

FIGS. 21*a-d* are various views of the joiner 1904 that may be used in embodiments of the present invention to attach adjacent fixtures. FIG. 21*a* is a perspective view; FIG. 21*b* is a top elevation view; FIG. 21*c* is a side elevation view; and FIG. 21*d* is an end elevation view. This particular joiner 1904 comprises a groove 1908 that is sized to receive portions of the end panels 204 (shown in FIG. 2) that protrude above the lens 214. In some cases the groove 1908 may also accommodate the spacer portion 504 of a gap filler element 216 (shown in FIG. 5). The groove 1908 helps to align the adjacent fixtures 1902*a*, 1902*b* during assembly and allows the joiner to lay flush against surfaces of the adjacent lenses. As previously noted, in this embodiment the fasteners 1906 comprise clips that snap-fit to the reflectors. The joiner 1904 may be manufactured using many different materials, with one suitable material being a polycarbonate material, for example. The joiner 1904 may be manufactured using many different fabrication processes, such as an injection mold process or an extrusion process, for example.

It is understood that embodiments presented herein are meant to be exemplary. Embodiments of the present invention can comprise any combination of compatible features shown in the various figures, and these embodiments should not be limited to those expressly illustrated and discussed. Many other versions of the configurations disclosed herein are possible. Thus, the spirit and scope of the invention should not be limited to the versions described above.

We claim:

1. A light fixture, comprising:

an elongated base comprising end panels at both ends;

a light engine removably fastened to said base; and at least one elongated reflector extending away from said base such that at least some light emitted from said light engine impinges on said reflector and is redirected in a primary emission direction, wherein said reflector redirects at least some light emitted from said light engine in a direction opposite said primary emission direction;

wherein said reflector is mounted to at least one outside surface of said base.

2. The light fixture of claim 1, said at least one reflector shaped to define at least one louvre to allow light to pass through said reflector.

3. The light fixture of claim 2, said reflector comprising at least one linear portion that is bent inward away from said base to define said at least one louvre.

4. The light fixture of claim 1, said at least one reflector comprising a plurality of louvres along the length of said reflector, said louvres shaped to redirect at least a portion of light emitted from said light engine in a direction opposite said primary emission direction.

5. The light fixture of claim 1, said at least one reflector comprising two reflectors, one on each side of said light engine, said reflectors running along the length of said fixture.

6. The light fixture of claim 1, said reflector connected to said base or said light engine with a snap-fit structure.

7. The light fixture of claim 1, further comprising a gap filler element between said light engine and one of said end panels.

8. The light fixture of claim 7, said gap filler element comprising:

a spacer portion between an end of said light engine and said end panel; and an internal ridge protruding from said spacer portion, said ridge shaped to conform to an interior surface of said light engine.

9. The light fixture of claim 1, further comprising a joiner at one end of said fixture, said joiner comprising an attachment mechanism for joining said fixture to another fixture in serial arrangement.

10. A light device, comprising:

at least two light fixtures connected in a serial arrangement, each of said light fixtures comprising:

an elongated base comprising end panels at both ends;

a light engine removably fastened to said base; and at least one elongated reflector extending away from said base; and a joiner joining consecutive ends of said light fixtures in said serial arrangement, said joiner comprising a groove for joining consecutive ends of each of said light fixtures, wherein edge portions of each of said end panels of said consecutive ends are shaped to be received by said groove.

11. The light device of claim 10, said joiner further comprising:

an elongated body spanning the width of said fixtures at a joint between consecutive fixtures;

at least one clip at an end of said body that is releasably attachable to an edge of said reflectors such that consecutive reflectors are connected.

12. The light device of claim 11, said groove sized to receive said edge portions of said end panels of consecutive fixtures.

13. The light device of claim 11, wherein said at least one clip attaches to said reflectors with a snap-fit mechanism.

14. The light device of claim 11, said joiner comprising fasteners at both ends of said body.

15. The light device of claim 10, wherein said joiner is shaped to conform to said light engine and said at least one reflector.

16. The light device of claim 10, wherein said joiner completely covers the joint between consecutive fixtures.

17. The light device of claim 10, said at least one reflector shaped to define at least one louvre to allow light to pass through said reflector.

18. The light device of claim 10, each of said light fixtures further comprising a gap filler element between said light engine and one of said end panels.

19. The light device of claim 18, said gap filler element comprising:

a spacer portion between an end of said light engine and said end panel; and an internal ridge protruding from said spacer portion, said ridge shaped to conform to an interior surface of said light engine.

20. A joiner device, comprising:

an elongated body shaped to conform to a surface of at least two adjacent structures;

fasteners on both ends of said body to removably attach said body to said adjacent structures; and a groove sized to receive a protruding portion of an end panel of each of said adjacent structures such that said adjacent structures are aligned when each of said protruding portions of said end panels are inserted into said groove.

* * * * *